US007416269B2

(12) United States Patent
Iwao

(10) Patent No.: US 7,416,269 B2
(45) Date of Patent: Aug. 26, 2008

(54) INK JET PRINTER, CONTROLLING METHOD FOR AN INK JET PRINTER, AND COMPUTER PROGRAM PRODUCT THEREFOR

(75) Inventor: Naoto Iwao, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 118 days.

(21) Appl. No.: 11/288,415

(22) Filed: Nov. 29, 2005

(65) Prior Publication Data

US 2006/0284908 A1 Dec. 21, 2006

(30) Foreign Application Priority Data

Nov. 30, 2004 (JP) ..... 2004-346526

(51) Int. Cl.
*B41J 29/38* (2006.01)

(52) U.S. Cl. ..... 347/11; 347/10; 347/5

(58) Field of Classification Search ..... 347/9, 347/10, 11, 12
See application file for complete search history.

(56) References Cited

U.S. PATENT DOCUMENTS

| | | | | |
|---|---|---|---|---|
| 6,099,103 | A | 8/2000 | Takahashi | |
| 6,808,254 | B2 | 10/2004 | Sakaida et al. | |
| 2003/0103118 | A1 | 6/2003 | Watanabe et al. | |
| 2003/0122902 | A1 | 7/2003 | Sakaida et al. | |
| 2003/0156164 | A1 | 8/2003 | Sakaida et al. | |
| 2004/0017413 | A1 * | 1/2004 | Kusunoki | 347/11 |
| 2004/0041885 | A1 | 3/2004 | Hirota | |
| 2004/0090498 | A1 | 5/2004 | Sakaida et al. | |
| 2004/0155915 | A1 | 8/2004 | Akiko et al. | |

FOREIGN PATENT DOCUMENTS

| | | |
|---|---|---|
| EP | 1 378 358 | 1/2004 |
| EP | 1 403 047 | 3/2004 |
| EP | 1 506 862 | 2/2005 |
| JP | 2001088293 | 4/2001 |
| JP | 2002144544 | 5/2002 |

* cited by examiner

*Primary Examiner*—Lam S Nguyen
(74) *Attorney, Agent, or Firm*—Banner & Witcoff, Ltd

(57) ABSTRACT

An ink jet printer is provided with an ink jet head and a controller. The ink jet head comprises a nozzle, an ink chamber communicating with the nozzle, a pressure chamber located between the nozzle and the ink chamber, and an actuator that changes volume of the pressure chamber. The controller controls the actuator to perform a first performance. The first performance includes a first change in which the volume of the pressure chamber increases and a second change in which the volume of the pressure chamber decreases. A period from the first change to the second change is 2/3×AL or below, or within a range between (2s−1/2)×AL and (2s+2/3)×AL, s is a positive integer. Discharging speed of ink discharged from the nozzle is substantially maximum if the period from the first change to the second change is set to AL.

12 Claims, 13 Drawing Sheets

FIG. 13

| TW2／U0 | Result |
|---|---|
| 1／8 | ○ |
| 2／8 | ○ |
| 3／8 | ○ |
| 4／8 | ○ |
| 5／8 | × |
| 6／8 | × |
| 7／8 | × |

FIG. 14

| X(μs) \ Y(μs) | 1 | 2 | 3 | 4 | 5 | 6 | 7 | 8 | 9 | 10 |
|---|---|---|---|---|---|---|---|---|---|---|
| 1 | — | — | ○ | ○ | × | × | × | × | ○ | ○ |
| 1.5 | — | — | — | ○ | × | × | × | × | ○ | ○ |
| 2 | — | — | — | — | × | × | × | × | △ | △ |
| 2.5 | — | — | — | — | — | × | × | × | △ | △ |
| 3 | — | — | — | — | — | — | × | × | △ | △ |
| 3.5 | — | — | — | — | — | — | — | × | △ | △ |
| 4 | — | — | — | — | — | — | — | — | △ | △ |
| 4.5 | — | — | — | — | — | — | — | — | — | × |

INK JET PRINTER, CONTROLLING METHOD FOR AN INK JET PRINTER, AND COMPUTER PROGRAM PRODUCT THEREFOR

CROSS-REFERENCE TO RELATED APPLICATION

This application claims priority to Japanese Patent Application No. 2004-346526, filed on Nov. 30, 2004, the contents of which are hereby incorporated by reference into the present application.

BACKGROUND OF THE INVENTION

1. Field of the Invention

The present invention relates to an ink jet printer. The present invention further relates to a method for controlling the ink jet printer, and to a computer program product for executing that method.

The ink jet printer of the present invention includes an devices for printing words, images, etc. by discharging ink towards a print medium. For example, the ink jet printer of the present invention includes copying machines, fax machines, multifunctional products, etc.

2. Description of the Related Art

An ink jet printer has an ink jet head. Usually, the ink jet head has a nozzle, an ink chamber, a pressure chamber, and an actuator. The nozzle discharges ink toward a print medium. The ink chamber houses ink. The nozzle communicates with the ink chamber. The pressure chamber is disposed between the nozzle and the ink chamber. The actuator faces the pressure chamber. Usually, a piezoelectric element is used as the actuator.

Pulse signals that have at least two levels (high voltage and low voltage) are applied to the piezoelectric element. For example, a pulse signal having a high voltage, this being a base voltage, is applied. The piezoelectric element to which the pulse signal is applied changes voltage in the sequence: high voltage, low voltage, high voltage. When the piezoelectric element changes from high voltage to low voltage, the piezoelectric element deforms away from the pressure chamber. The volume of the pressure chamber thus increases, and pressure within the pressure chamber is decreased. Ink is drawn from the ink chamber into the pressure chamber. When the piezoelectric element changes from low voltage to high voltage, the piezoelectric element deforms towards the pressure chamber. The volume of the pressure chamber thus decreases, and pressure within the pressure chamber is increased. The pressurized ink is discharged from the nozzle. Usually, one ink droplet is discharged from the nozzle when one pulse signal is applied to the piezoelectric element.

An ink jet printer having the above configuration is taught in U.S. Pat. No. 6,808,254.

If ink dries out within an ink passage between the ink chamber and the nozzle, the ink may not be discharged correctly from the nozzle. The present invention uses a new technique to prevent the ink from drying out within an ink passage.

BRIEF SUMMARY OF THE INVENTION

The present inventors observed the manner in which ink was discharged from the nozzle while making various changes to the period from the volume of the pressure chamber being increased to the volume of the pressure chamber being decreased (hereafter this period is termed maintenance period). As a result, they found that ink was not discharged from the nozzle when the maintenance period was set to a predetermined time. In this case, the ink oscillated within the ink passage due to a pressure wave being disseminated, is pressure wave having been generated by the pressure chamber decreasing pressure or increasing pressure. When the ink within the ink passage oscillates, the ink does not readily dry out. The present inventors developed a technique utilizing this phenomenon to prevent the ink within the ink passage from drying out.

Through repeated research, the present inventors discovered a range of the maintenance period within which the ink is not discharged from the nozzle. That is, if the maintenance period for substantially maximum discharge speed of ink discharged from the nozzle is AL, ink is on the whole not discharged from the nozzle when the maintenance period is set to a value $2/3\times AL$ or below. Further, they also found that ink is on the whole not discharged from the nozzle when the maintenance period is set to be within a range between $(2s-1/2)\times AL$ and $(2s+2/3)\times AL$. Here, s is a positive integer.

The ink within the ink passage may be made to oscillate when the maintenance period is set to be within the range $2/3\times AL$ or below, or between $(2s-1/2)\times AL$ and $(2s+2/3)\times AL$. In this case, the ink is not discharged from the nozzle, and the ink may be made to oscillate without being discharged. This technique is capable of preventing the ink within the ink passage from drying out.

BRIEF DESCRIPTION OF THE DRAWINGS

In FIG. 3, pressure chambers, apertures, and nozzles are shown by solid lines.

FIG. 6 (A) shows a state of the piezoelectric element when a high voltage has been applied FIG. 6 (B) shows a state of the piezoelectric element when a low voltage has been applied. FIG. 6 (C) shows a state of the piezoelectric element when a high voltage has again been applied.

FIG. 10 (B) shows how voltage of the piezoelectric element changes when the pulse signals of FIG. 10 (A) have been applied.

FIG. 11 (B) shows how the voltage of the piezoelectric element changes when the pulse signals of FIG. 11 (A) have been applied.

FIG. 13 shows results of testing as to whether dots are formed well when a value of TW2 is changed.

FIG. 14 shows results observing whether ink is discharged when TW1 and TW2 are changed.

DETAILED DESCRIPTION OF THE INVENTION

Figure 1:
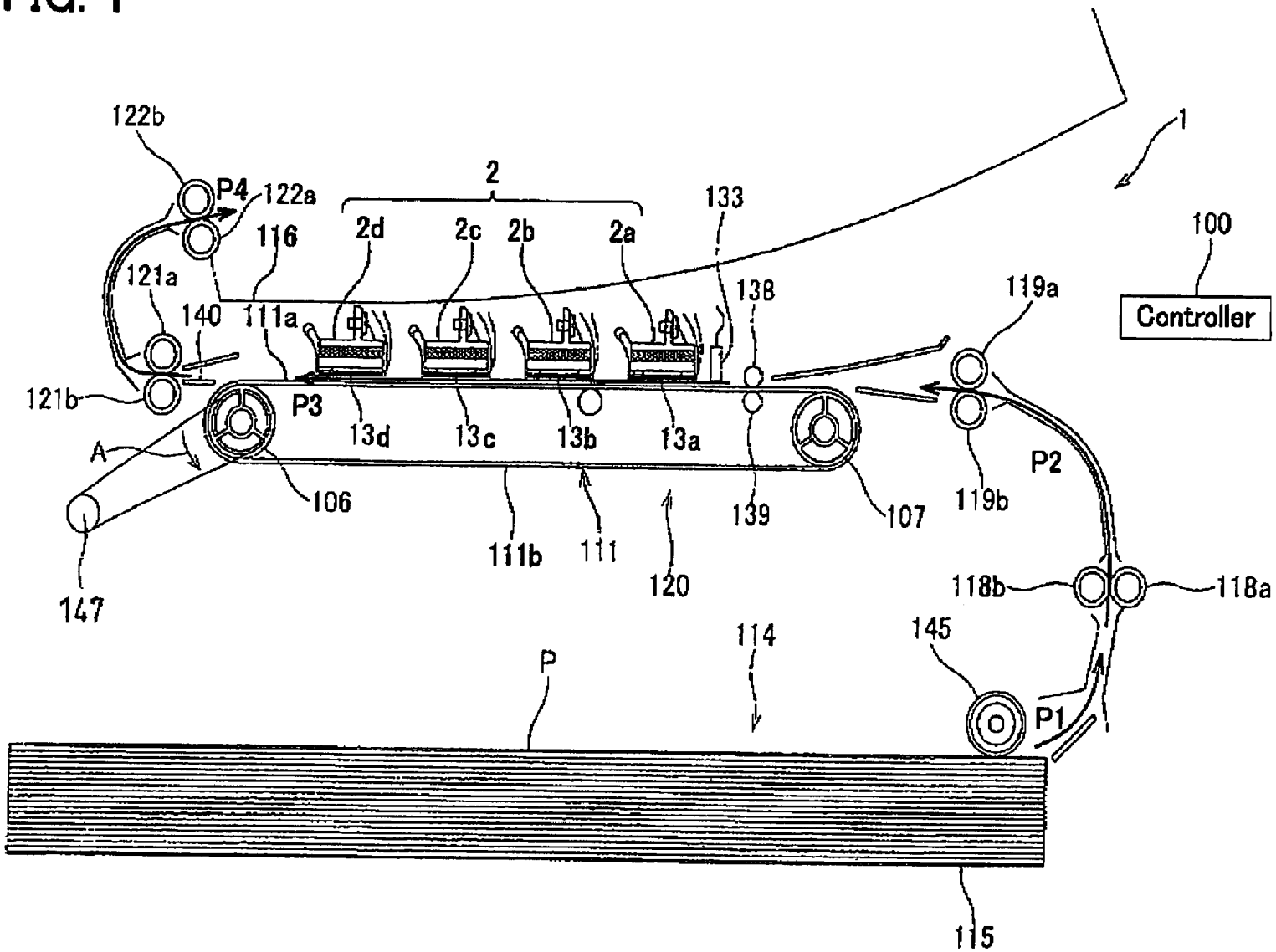
FIG. 1 shows a schematic block diagram of an ink jet printer.

Below, a situation where ink oscillates within an ink passage in a state in which the ink is not discharged is termed preliminary oscillation. A controller of the ink jet printer may control an actuator to perform a first performance. The first performance includes a first change in which volume of a pressure chamber increases, and a second change in which the volume of the pressure chamber decreases. As described above, it is preferred that a period from the first change to the second change (the maintenance period) is 2/3×AL or below, or within the range between (2s−1/2)×AL and (2s+2/3)×AL.

If the maintenance period is set to a value other that the aforementioned range, the ink may be discharged from the nozzle. That is, if the maintenance period is set to within the range between (2t−4/3)×AL and (2t−1/2)×AL, the ink may be discharged from the nozzle.

The controller may control the actuator to perform a second performance. The second performance includes a third change in which the volume of the pressure chamber increases, and a fourth change in which the volume of the pressure chamber decreases. It is preferred that the period from the third change to the fourth change is the range between (2t−4/3)×AL and (2t−1/2)×AL. t is a positive integer. According to this configuration, the actuator may perform the first performance for preventing the ink from drying out, and may perform the second performance for discharging the ink.

The ink jet printer may comprise a transferring device that transfers the ink jet head and/or a print medium along a predetermined direction in a state in which the nozzle faces the print medium.

In this case, the ink jet printer may print on the print medium by repeating a unit period while the transferring device transfers the ink jet head and/or the print medium along the predetermined direction. The controller way control the actuator to perform either the first performance or the second performance in each unit period. The nozzle may discharge ink to form one dot when the actuator performs the second performance in one unit period. The nozzle may not discharge ink when the actuator performs the first performance in one unit period.

When the first performance is performed, a pressure wave is generated within the ink passage. When the second performance is performed while the pressure wave is still remaining, the ink may not be discharged well. For example, the discharge speed of the ink may be slower. As a result, it is preferred that a period from the second change of the fast performance performed in the unit period to the third change of the second performance performed in the next unit period is longer than half of one unit period.

With this configuration, the period between the first performance and the second performance may be made longer. As a result, the pressure wave generated in the first performance may be weaker by the time the second performance is to be performed. The pressure wave generated in the first performance does not adversely affect the second performance.

Furthermore, it is preferred that a period from the fourth change of the second performance performed in the unit period to the third change of the second performance performed in the next unit period is longer than half of one unit period.

With this configuration, the period between the former second performance and the latter second performance may be made longer. The pressure wave generated in the former second performance may be weaker by the time the latter second performance is to be performed. The pressure wave generated in the former second performance does not adversely affect the latter second performance.

The controller may control the actuator to perform the first performance at least twice in one unit period.

In this case, the preliminary oscillation is performed a plurality of times in one unit period, and consequently the ink may effectively be prevented from drying out.

It is preferred that, if the first performance is performed at least twice in one unit period, a period from the second change of the first performance performed in one unit period to the third change of the second performance performed in the next unit period is longer than half of one unit period.

If this is done, the pressure wave generated in the first performance does not adversely affect the second performance.

The controller may control the actuator to perform the first performance twice in one unit print period. In this case, ink may be discharged from the nozzle even if a period from the first change and the second change of the latter first performance has been set within the aforementioned range. A conjectured reason for this is that the pressure wave generated in the former first performance is affecting the latter first performance. The present inventors found that ink was not discharged from the nozzle when the former first performance and the latter first performance were set to have a relationship in which a period from the first change of the former first performance to the second change of the latter first performance is 2/3×AL or below, or within a range between (2u−1/2)×AL and (2u+2/3)×AL. Here, u is a positive integer.

If this is done, ink may not be discharged from the nozzle even if the first performance is performed twice in one unit period.

It is preferred that the period from the fast change to the second change is 2/3×AL or below. It is more preferred that the period from the first change to the second change is within a range between 1/6×AL and 1/4×AL.

The actuator may be a piezoelectric element. In this case, the controller may change the voltage applied to the piezoelectric element from a first level to a second level in order to perform the first change and the third change. Further, the controller may change the voltage applied to the piezoelectric element from the second level to the first level in order to perform the second change and the fourth change.

If this is done, the voltage difference required for the first performance is the same as the voltage difference required for the second performance. The voltage may therefore be applied to the piezoelectric element using a simpler circuit configuration.

Embodiment

An ink jet printer 1 of a first embodiment will be described with reference to the drawings. Below, the ink jet printer 1 may simply be referred to as printer 1. FIG. 1 is a schematic block diagram of the printer 1.

The printer 1 has a controller 100. The controller 100 executes general control of the operation of the printer 1.

The printer 1 has a paper supply device 114. This paper supply device 114 has a paper housing section 115, a paper supply roller 145, a pair of rollers 118*a* and 118*b*, a pair of rollers 119*a* and 119*b*, etc. The paper housing section 115 can house a plurality of sheets of printing paper P in a stacked state. The printing paper P has a rectangular shape extending in the left-right direction of FIG. 1. The paper supply roller 145 delivers the uppermost sheet of printing paper P in the paper housing section 115 in the direction of the arrow P1. The printing paper P that was transported in the direction of the arrow P1 is then transported in the direction of the arrow P2 by the pair of rollers 118*a* and 118*b* and the pair of rollers 119*a* and 119*b*.

The printer 1 has a conveying unit 120. The conveying unit 120 conveys the printing paper P, that has been transported in the direction of the arrow P2, in the direction P3. The conveying unit 120 has a belt 111, belt rollers 106 and 107, etc. The belt 111 is wound across the belt rollers 106 and 107. The belt 111 is adjusted to have a length such that a predetermined tension is generated when it is wound across the belt rollers 106 and 107. The belt 111 has an upper face 11*a* that is located above the belt rollers 106 and 107, and a lower face 111*b* that is located below the belt rollers 106 and 107. The first belt roller 106 is connected to a conveying motor 147. The conveying motor 147 is caused to rotate by the controller 100. The other belt roller 107 rotates following the rotation of the belt roller 106. When the belt rollers 106 and 107 rotate, the printing paper P mounted on the upper face 111*a* of the belt 111 is conveyed in the direction shown by the arrow P3.

A pair of nip rollers 138 and 139 is disposed near the belt roller 107. The upper nip roller 138 is disposed at an outer peripheral side of the belt 111. The lower nip roller 139 is disposed at an inner peripheral side of the belt 111. The belt 111 is gripped between the pair of nip rollers 138 and 139. The nip roller 138 is energized downwards by a spring (not shown). The nip roller 138 pushes the printing paper P onto the upper face 111*a* of the belt 111. In the present embodiment, an outer peripheral face of the belt 1111 comprises adhesive silicon gum. As a result, the printing paper P adheres reliably to the upper face 111*a* of the belt 111.

A sensor 133 is disposed to the left of the nip roller 138. The sensor 133 is a light sensor comprising a light emitting element and a light receiving element. The sensor 133 detects a tip of the printing paper P. Detection signals of the sensor 133 are sent to the controller 100. The controller 100 can determine that the printing paper P has reached a detecting position when the detection signals from the sensor 133 are input.

The printer 1 has a head unit 2. The head unit 2 is located above the conveying unit 120. The head unit 2 has four ink jet heads 2*a*, 2*b*, 2*c*, and 2*d*. The ink jet heads 2*a* to 2*d* are all fixed to a printer main body (not shown). The ink jet heads 2*a* to 2*d* have ink discharging faces 13*a* to 13*d* respectively. The ink discharging faces 13*a* to 13*d* are formed at lower faces of the ink jet heads 2*a* to 2*d*. Ink is discharged downwards from the ink discharging aces 13*a* to 13*d* of the ink jet heads 2*a* to 2*d*. The ink jet heads 2*a* to 2*d* have an approximately rectangular parallelopiped shape that extends in a perpendicular direction relative to the plane of the page of FIG. 1. Magenta (N) ink is discharged from the ink jet head 2*a*. Yellow (Y) ink is discharged from the ink jet head 2*b*. Cyan (C) ink is discharged from the ink jet head 2*c*. Black (K) ink is discharged from the ink jet head 2*d*. In the present embodiment, four colors of ink can be used to perform color printing of the printing paper P. The configuration of the ink jet heads 2*a* to 2*d* will be described in detail later. The operation of the ink jet heads 2*a* to 2*d* is controlled by the controller 100.

A space is formed between the ink discharging faces 13*a* to 13*d* of the ink jet heads 2*a* to 2*d* and the upper face 111*a* of the belt 111. The printing paper P is transported towards the left (in the direction of the arrow P3) along this space. Ink is discharged from the ink jet heads 2*a* to 2*d* onto the printing paper P during this process of delivery in the direction of the arrow P3. The printing paper P is thus printed with color words or images. In the present embodiment, the ink jet beads 2*a* to 2*d* are fixed. That is, the printer 1 of the present embodiment is a line type printer.

A plate 140 is supplied to the left of the conveying unit 120. When the printing paper P is transported in the direction of the arrow P3, a right edge of the plate 140 enters between the printing paper P and the belt 11, thus separating the printing paper P from the belt 111. A pair of rollers 121*a* and 121*b* is formed to the left of the plate 140. Further, a pair of rollers 122*a* and 122*b* is formed above the pair of rollers 121*a* and 121*b*. The printing paper P, which has been transported in the direction of the arrow P3, is transported in the direction of an arrow P4 by the pair of rollers 121*a* and 121*b* and the pair of rollers 122*a* and 122*b*. A paper discharge section 116 is disposed to the right of the rollers 122*a* and 122*b*. The printing paper P that has been transported in the direction of the arrow P4 is received in the paper discharge section 116. The paper discharge section 116 can maintain a plurality of printed sheets of printing paper P in a stacked state.

Next, the configuration of the ink jet head 2*a* will be described. Since the other ink jet heads 2*b* to 2*d* have the same configuration as the ink jet head 2*a*, a detailed description thereof will be omitted.

Figure 2:
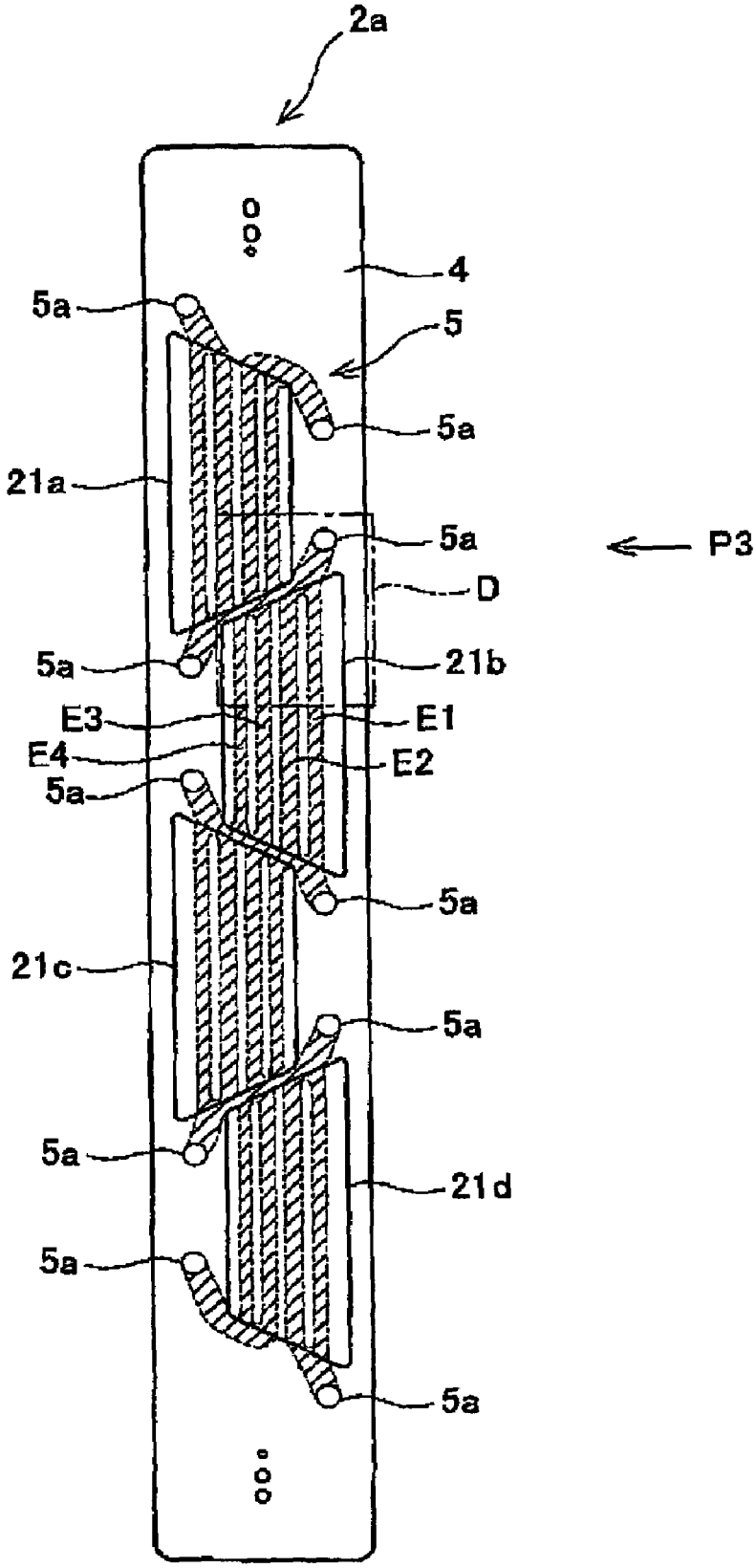
FIG. 2 shows a plan view of an ink jet head.

FIG. 2 shows a plan view of the ink jet head 2*a* viewed from above FIG. 1. The ink jet head 2*a* has a passage unit 4 and four actuator units 21*a*, 21*b*, 21*c*, and 21*d*.

Ink passages 5 are formed within the passage unit 4. In FIG. 2, main ink passages 5 within the passage unit 4 are shown by hatching. A plurality of openings 5*a* is formed in a surface (a face of the proximate side perpendicular to the plane of the page of FIG. 2) of the passage unit 4. These openings 5*a* are connected to an ink tank (not shown). In the case of the ink jet head 2*a*, the openings 5*a* are connected to an ink tank that houses magenta ink. The ink in the ink tank is led into the passage unit 4 via the openings 5*a*. The ink discharging face 13*a* is formed at a lower face (a face of a far side perpendicular to the plane of the page of FIG. 2) of the passage unit 4.

The ink passages 5 of the passage unit 4 have ink chambers E1 to E4. The ink chambers E1 to E4 are formed in a region that faces the actuator units 21*a* to 21*d*. In FIG. 2, reference numbers have been applied only to the ink chambers E1 to E4 facing the actuator unit 21*b*. Actually, however, four ink chambers are also formed in a region facing the actuator unit 21*a*, and four ink chambers are formed respectively in regions facing the actuator units 21*c* and 21*d*. The ink chambers E1 to E4 extend in the up-down direction of FIG. 2. The ink chambers E1 to E4 are aligned so as to be parallel in the left-right direction of FIG. 2. The ink chambers E1 to E4 are filled with ink that was introduced from the ink tank via the openings 5*a*.

The four actuator units 21*a* to 21*d* are fixed to the surface (a face of the proximate side perpendicular to the plane of the page of FIG. 2) of the passage unit 4. The actuator units 21*a* to 21*d* each have a trapezoid shape when viewed from a plan view. The actuator units are aligned in the sequence 21*a*, 21*b*, 21*c*, and 21*d* from an upper side of FIG. 2. The actuator units 21*a* and 21*c* are disposed such that short edges thereof are at the right side and long edges thereof are at the left side. The actuator units 21*b* and 21*d* are disposed such that short edges thereof are at the left side and long edges thereof are at the right side. The actuator units 21*a* and 21*b* are disposed so as to overlap in the left-right direction of FIG. 2. Further, the actuator units 21*a* and 21*b* are disposed so as to overlap in the up-down direction of FIG. 2. Similarly, the actuator units 21*b* and 21*c* are disposed so as to overlap in the left-right direction and the up-down direction. The actuator units 21*c* and 21*d* are disposed so as to overlap in the left-right direction and the up-down direction.

An FPC (Flexible Printed Circuit: not shown) is connected to the actuator units 21*a* to 21*d*. The FPC applies discharging pulse signals and preliminary pulse signals (to be described)

to the actuator units 21*a* to 21*d*. The actuator units 21*a* to 21*d* increase or reduce the pressure of ink within pressure chambers 10 (to be described: see FIG. 3, etc.) of the passage unit 4 in response to the pulse signals.

Below, unless otherwise specified, the actuator units 21*a* to 21*d* are represented the reference number 21.

Figure 3:
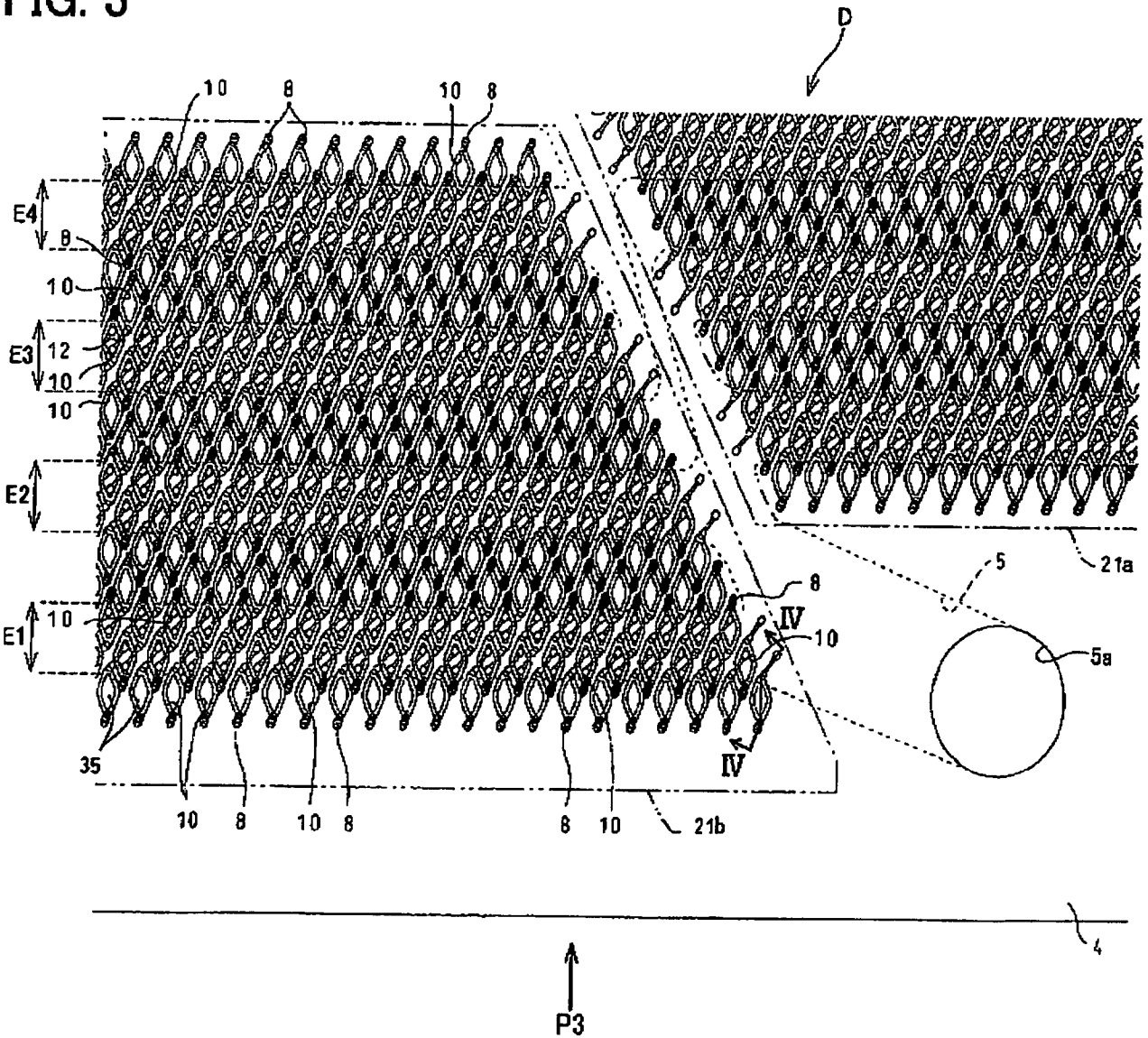
FIG. 3 shows an expanded view of a region D of FIG. 2.

FIG. 3 is an expanded plan view of a region D of FIG. 2. In FIG. 3, nozzles 8, pressure chambers 10, and apertures 12 which actually cannot be seen are shown by solid lines.

As shown in FIG. 3, a plurality of nozzles 8, a plurality of pressure chambers 10 and a plurality of apertures 12, etc. are formed within the passage unit 4. The number of nozzles 8, of pressure chambers 10, and of apertures 12 is identical. In FIG. 3, not all the nozzles 8, pressure chambers 10, and apertures 12 are numbered.

The actuator units 21 have a plurality of individual electrodes 35. One individual electrode 35 faces one pressure chamber 10. The number of individual electrodes 35 is identical with the number of pressure chambers 10.

Figure 4:
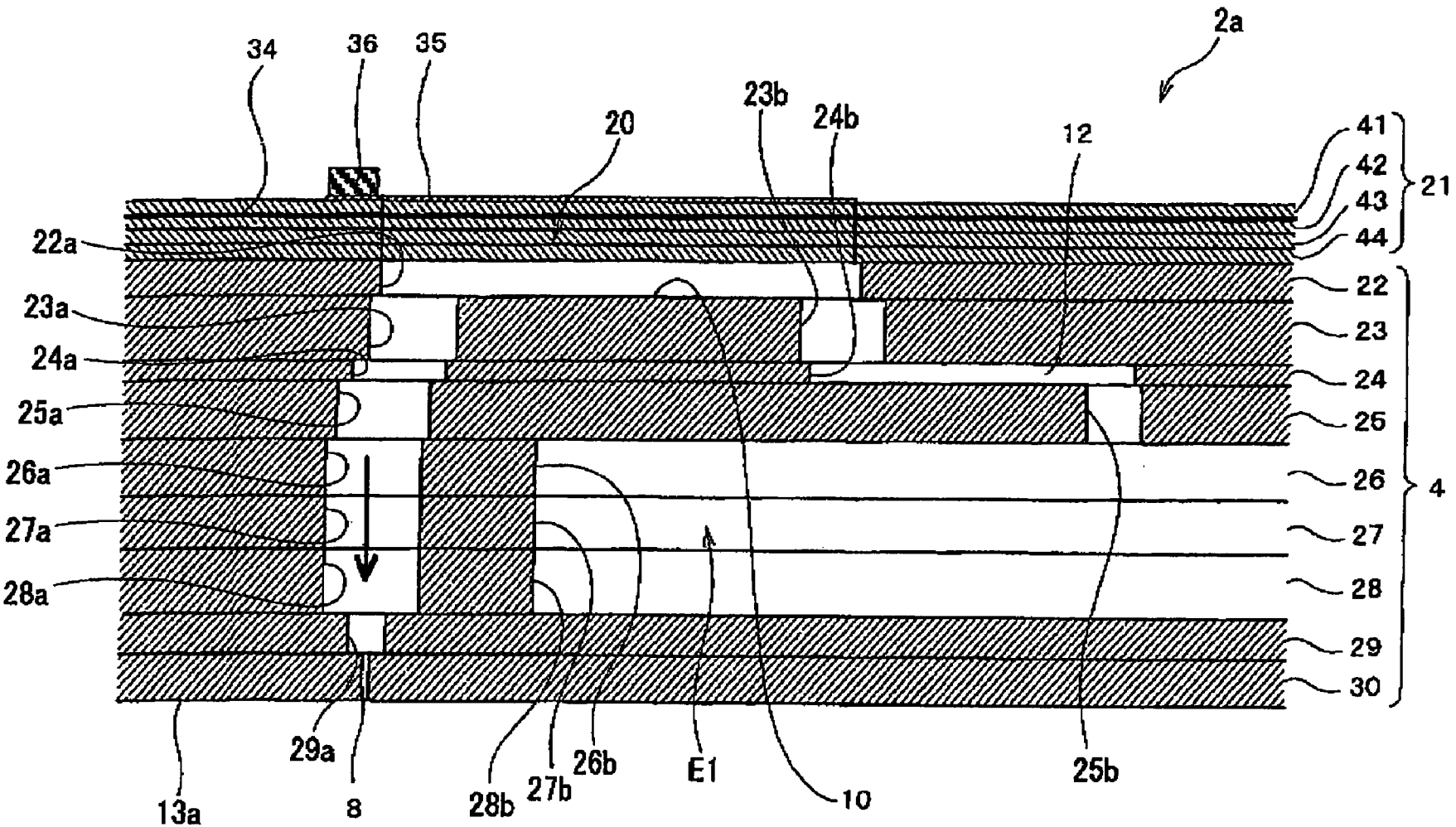
FIG. 4 shows a cross-sectional view along the line IV-IV of FIG. 3.

The structure of the passage unit 4 and the actuator unit 21 will be described in detail with reference to FIG. 4. FIG. 4 is a cross-sectional view along the line IV-IV of FIG. 3.

The passage unit 4 is a structure in which nine metal plates 22 to 30 have been stacked. The nozzle 8 is formed in a nozzle plate 30, and passes through this nozzle plate 30. Only one nozzle 8 is shown in FIG. 4. However, a plurality of nozzles 8 is actually formed (see FIG. 3).

A cover plate 29 is stacked on a surface of the nozzle plate 30. A trough hole 29*a* is formed in the cover plate 29. The trough hole 29*a* is formed in a position corresponding to the nozzle 8 of the nozzle plate 30.

Three manifold plates 26, 27, and 28 are stacked on a surface of the cover plate 29. A through hole 26*a* is formed in the manifold plate 26. A through hole 27*a* is formed in the manifold plate 27, and a through hole 28*a* is formed in the manifold plate 28. The through holes 26*a*, 27*a*, and 28*a* are formed in a position corresponding to the through hole 29*a* of the cover plate 29. The manifold plates 26, 27, and 28 have long holes 26*b*, 27*b*, and 28*b* respectively. The long holes 26*b*, 27*b*, and 28*b* have the shape of the ink passages 5 shown in FIGS. 2 and 3. The long holes 26*b*, 27*b*, and 28*b* are each formed in the same position. Spaces formed by the long holes 26*b*, 27*b*, and 28*b* are the ink passages 5. In FIG. 4, the ink chamber E1, which is a part of the ink passage 5, is shown.

A supply plate 25 is stacked on a surface of the manifold plate 26. A through hole 25*a* is formed in the supply plate 25. The through hole 25*a* is formed in a position corresponding to the through hole 26*a* of the manifold plate 26. Further, a through hole 25*b* is formed in the supply plate 25. The through hole 25*b* is formed in a position corresponding to the long hole 26*b* of the manifold plate 26.

An aperture plate 24 is stacked on a surface of the supply plate 25. A through hole 24*a* is formed in the aperture plate 24. The through hole 24*a* is formed in a position corresponding to the through hole 25*a* of the supply plate 25. Further, a long hole 24*b* is formed in the aperture plate 24. A right edge of the long hole 24*b* is formed in a position corresponding to the through hole 25*b* of the supply plate 25. The long hole 24*b* functions as the aperture 12.

A base plate 23 is stacked on a surface of the aperture plate 24. A through hole 23*a* is formed in the base plate 23. The through hole 23*a* is formed in a position corresponding to the through hole 24*a* of the aperture plate 24. Further, a through hole 23*b* is formed in the base plate 23. The through hole 23*b* is formed in a position corresponding to a left edge of the long hole 24*b* of the aperture plate 24.

A cavity plate 22 is stacked on a surface of the base plate 23. A long hole 22*a* is formed in the cavity plate 22. A left edge of the long hole 22*a* is formed in a position corresponding to the through hole 23*a* of the base plate 23. A right edge of the long hole 22*a* is formed in a position corresponding to the through hole 23*b* of the base plate 23. The long hole 22*a* functions as the pressure chamber 10. The pressure chamber 10 communicates with the ink chamber E1 via the through hole 23*b*, the aperture 12, and the through hole 25*b*. Further, the pressure chamber 10 communicates with the nozzle 8 via the through hole 23*a*, the through hole 24*a*, the through hole 25*a*, the through hole 26*a*, the through hole 27*a*, the through hole 28*a*, and the through hole 29*a*.

As shown in FIG. 3, the pressure chambers 10 are substantially diamond shaped when viewed from a plan view. The plurality of pressure chambers 10 is disposed in a staggered pattern. One pressure chamber row is formed by aligning a plurality of the pressure chambers 10 in a direction orthogonal to the direction of the arrow P3 (the left-right direction of FIG. 3). Sixteen pressure chamber rows are aligned in the direction of P3 within a region corresponding to one actuator unit 21. Each pressure chamber 10 communicates with one out of the ink chambers E1 to E4.

One nozzle row is formed by aligning a plurality of the nozzles 8 in a direction orthogonal to the direction of the arrow P3. Sixteen nozzle rows are aligned in the direction of P3 within a region corresponding to one actuator unit 21. Each nozzle 8 communicates with one out of the pressure chambers 10. As shown in FIG. 3, when the ink jet head 2 is viewed from a plan view, none of the nozzles 8 overlap with the ink chambers E1 to E4.

The nozzles 8 are mutually offset in the direction orthogonal to the direction of the arrow P3. That is, if the nozzles 8 are projected from the direction P3 on a straight line (a projective line) extending in the direction orthogonal to the arrow P3, the nozzles 8 will be present at differing positions on this projective line. The nozzles 8 are equally spaced on the projective line. This spacing is a distance corresponding to 600 dpi. This 600 dpi is the resolution in the direction orthogonal to the arrow P3.

Returning to FIG. 4, the configuration of the actuator unit 21 will be described. The actuator unit 21 is connected to the surface of the cavity plate 22. Actually, the four actuator units 21*a* to 21*d* are connected to the cavity plate 22.

The actuator unit 21 comprises four piezoelectric sheets 41, 42, 43, and 44, a common electrode 34, the individual electrodes 35, etc. The thickness of each of the piezoelectric sheets 41 to 44 is approximately 15 μm. The thickness of the actuator unit 21 is approximately 60 μm. Each of the piezoelectric sheets 41 to 44 has approximately the same area as the single actuator unit 21 shown in FIGS. 2 and 3. That is, the piezoelectric sheets 41 to 44 each have a trapezoid shape when viewed from a plan view. The piezoelectric sheets 41 to 44 extend across the plurality of pressure chambers 10. The piezoelectric sheets 41 to 44 are formed from ferroelectric lead zirconate titanate (PZT) ceramic material.

The common electrode 34 is disposed between the uppermost piezoelectric sheet 41 and the piezoelectric sheet 42 formed below the piezoelectric sheet 41. The common electrode 34 has approximately the same area as the piezoelectric sheets 41 to 44, and has a trapezoid shape when viewed from a plan view. The common electrode 34 has a thickness of approximately 2 μm. The common electrode 34 is made from a metal material such as, for example, Ag—Pd. Electrodes are not disposed between the piezoelectric sheet 42 and the piezoelectric sheet 43, between the piezoelectric sheet 43 and the piezoelectric sheet 44, or between the piezoelectric sheet 44 and the cavity plate 22. The common electrode 34 is connected with a ground (not shown).

A plurality of the individual electrodes 35 that have a thickness of 1 μm is disposed on the surface of the uppermost piezoelectric sheet 41. Each individual electrode 35 is disposed in a position corresponding to one of each of the pressure chambers 10. The individual electrodes 35 are made from a metal material such as, for example, Ag—Pd. A land 36 having a thickness of approximately 15 μm is formed at one end of each individual electrode 35. The lands 36 are substantially circular when viewed from a plan view, and the diameter thereof is approximately 160 μm. The individual electrodes 35 and the lands 36 are joined conductively. The lands 36 may be composed of, for example, meal that contains glass flit. The lands 36 electrically connect the individual electrodes 35 with contacts formed on the FPC (not shown). The individual electrodes 35 are electrically connected with a driver IC 220 (to be described; see FIG. 7) via the contacts and wiring of the FPC. The driver IC 220 is controlled by the controller 100. The controller 100 can thus individually control the voltage of each of the individual electrodes 35.

Figure 5:
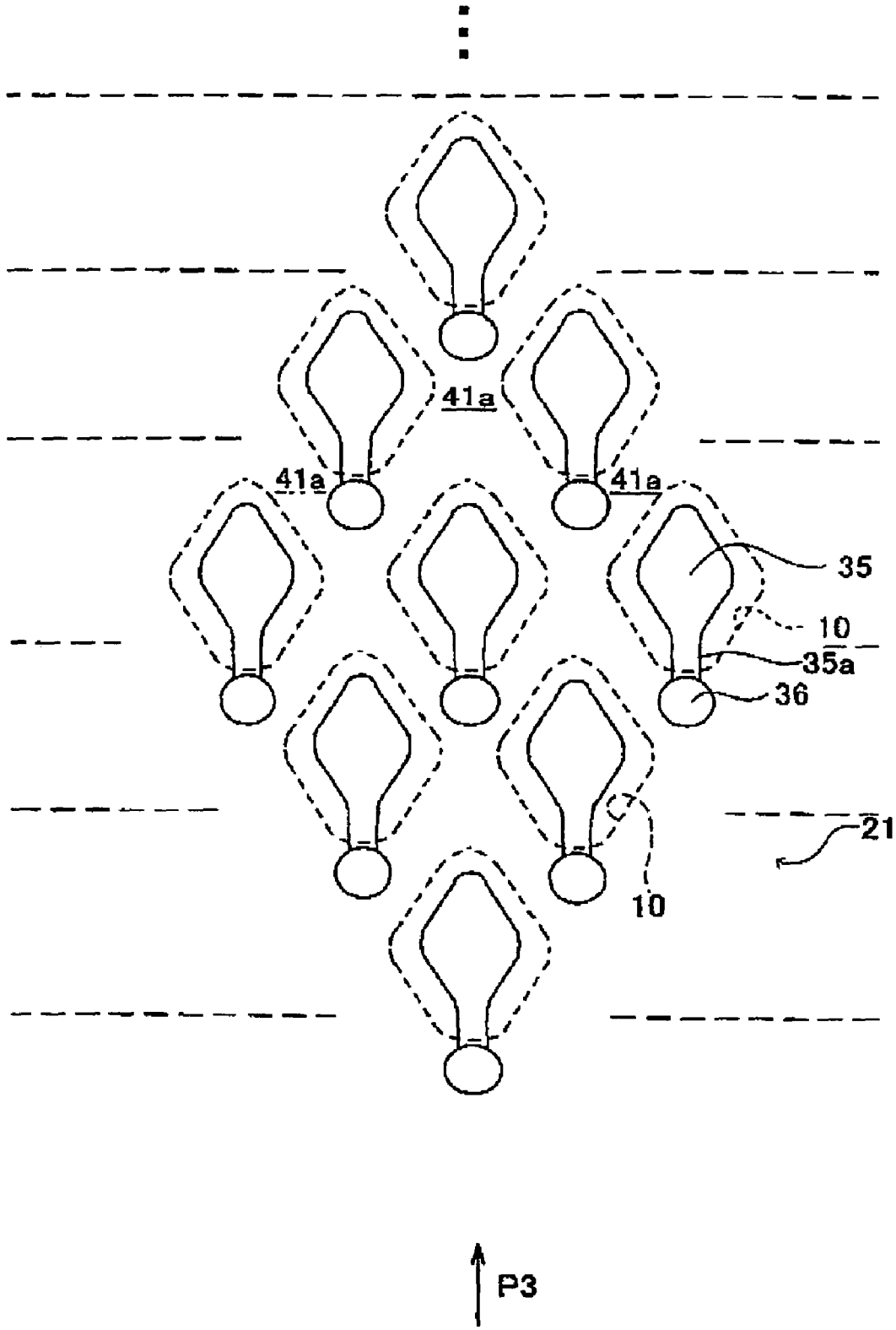
FIG. 5 shows an expanded plan view of a portion of an actuator unit.

FIG. 5 shows an expanded plan view of a portion of the actuator unit 21. As shown in FIG. 5, the individual electrodes 35 are substantially diamond shaped when viewed from a plan view. One individual electrode 35 faces one pressure chamber 10. The individual electrodes 35 are smaller than the pressure chambers 10. The major part of the individual electrodes 35 overlaps with the pressure chambers 10. A protruding part 35*a* is formed on the individual electrodes 35. This protruding part 35*a* extends downwards from an acute angle of a lower side of the diamond shape (the lower side of FIG. 5). The protruding part 35*a* extends into regions 41*a* in which the pressure chambers 10 are not formed. The lands 36 are formed in these regions 41*a*.

Since one individual electrode 35 faces one pressure chamber 10, the individual electrodes 35 are disposed with the same pattern as the pattern with which the pressure chambers 10 are disposed. That is, the plurality of individual electrodes 35 that is aligned in the direction orthogonal to the arrow P3 forms an electrode row. Sixteen electrode rows are aligned in the direction of the arrow P3 within one actuator unit 21.

In the present embodiment, the individual electrodes 35 are formed only on the surface of the actuator unit 21. As will be described in detail later, only the piezoelectric sheet 41 between the common electrode 34 and the individual electrodes 35 forms an activated part of the piezoelectric sheets. With this type of configuration, the unimorph deformation in the actuator unit 21 has superior deformation efficiency.

When a voltage difference is applied between the common electrode 34 and the individual electrodes 35, a region of the piezoelectric sheet 41 to which the electric field is applied deforms due to piezoelectric effects. The part that deforms functions as an active part. The piezoelectric sheet 41 can expand and contract in its direction of thickness (the stacking direction of the actuator unit 21), and can expand and contract in its plane direction. The other piezoelectric sheets 42 to 44 that are not located between the individual electrodes 35 and the common electrode 34 are non-active layers. Consequently, they cannot deform spontaneously even when a voltage difference is applied between the individual electrodes 35 and the common electrode 34. In the actuator unit 21, the upper piezoelectric sheet 41 that is farther from the pressure chambers 10 is the active part, and the lower piezoelectric sheets 42 to 44 that are closer to the pressure chambers 10 are non-active parts. This type of actuator unit 21 is termed a unimorph type.

When voltage difference is applied between the common electrode 34 and the individual electrodes 35 such that the direction of the electric field and the direction of polarization have the same direction, the active part of the piezoelectric sheet 41 contracts in a planar direction. By contrast, the piezoelectric sheets 42 to 44 do not contract. There is thus a difference in the rate of contraction of the piezoelectric sheet 41 and the piezoelectric sheets 42 to 44. As a result, the piezoelectric sheets 41 to 44 (including the individual electrodes 35) deform so as to protrude towards the pressure chamber 10 side. The pressure in the pressure chambers 10 is thus increased. By contrast, when there is zero voltage difference between the common electrode 34 and the individual electrodes 35, the state wherein the piezoelectric sheets 41 to 44 protrude towards the pressure chamber 10 side is released. The pressure in the pressure chambers 10 is thus decreased.

The voltage of the individual electrodes 35 is controlled individually. There is deformation of the parts of the piezoelectric sheets 41 to 44 facing the individual electrodes 35 in which the voltage has been changed. One piezoelectric element 20 (see FIG. 4) is formed from one individual electrode 35 and the region facing that individual electrode 35 (the region of the piezoelectric sheets 41 to 44 (i.e. the common electrode 35)). Only one piezoelectric element 20 has been shown in FIG. 4. However, there is the same number of piezoelectric elements 20 as the number of individual electrodes 35 (the same number as the number of pressure chambers 10). The piezoelectric elements 20 are disposed with the same pattern as the pattern with which the individual electrodes 35 are disposed. That is, element rows are formed from a plurality of the piezoelectric elements 20 that is aligned in the direction of P3. Sixteen element rows are aligned in the direction of P3 within one actuator unit 21. The voltage of each piezoelectric element 20 is controlled individually by the controller 100.

The operation of the ink jet head 2 configured as described above will be described with reference to FIG. 6 (A) to (C). A discharging pulse signal S is applied to the piezoelectric element 20 (the individual electrode 35) corresponding to the nozzle 8 so as to discharge an ink droplet from that nozzle 8.

Figure 6:
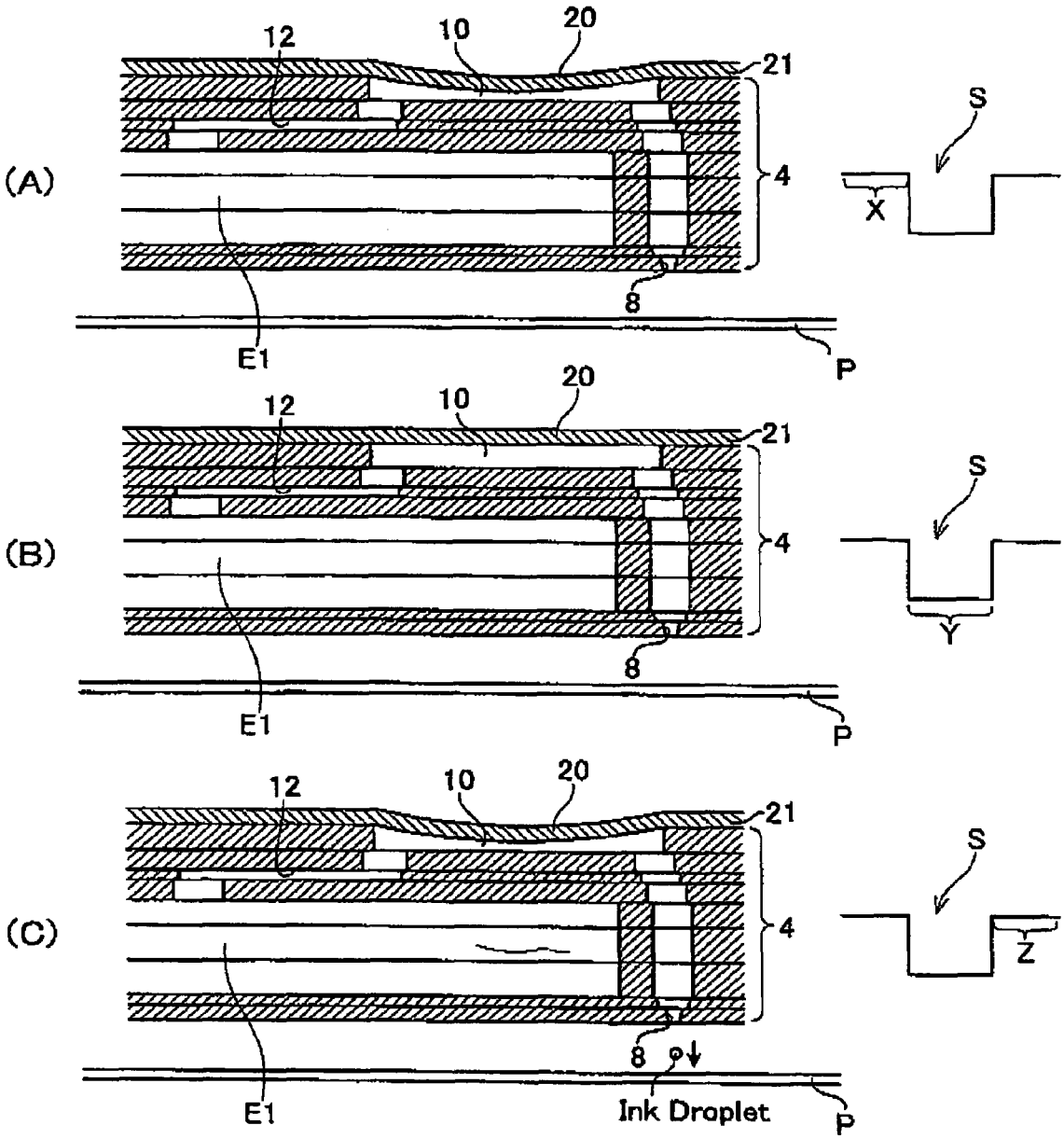
FIG. 6 shows a time sequence of changes of a piezoelectric element when one pulse signal is applied to the piezoelectric element.

When printing is not being performed, a voltage higher than the voltage of the common electrode 34 is maintained in the individual electrode 35 (the region X of the pulse signal in FIG. 6 (A)). In this state, the piezoelectric element 20 protrudes towards the pressure chamber 10 side (see FIG. 6 (A)).

The individual electrode 35 of the piezoelectric element 20 is made to have the same voltage as the common electrode 34 (the region Y of the pulse signal in FIG. 6 (B)). The piezoelectric element 20 thus deforms upwards relative to FIG. 6, the volume of the pressure chamber 10 increases, and the pressure in the pressure chamber 10 is decreased. In this state, the piezoelectric element 20 assumes the state shown in FIG. 6 (B). When the pressure in the pressure chamber 10 decreases, the ink in the ink chamber E1 is led into the pressure chamber 10 via the aperture 12. The pressure chamber 10 is thus filled with ink.

Next, the individual electrode 35 of the piezoelectric element 20 is returned to high voltage (the region Z of the pulse signal in FIG. 6 (C)). The piezoelectric element 20 deforms downwards, the volume of the pressure chamber 10 decreases, and the pressure in the pressure chamber 10 increases. The ink in the pressure chamber 10 is thus pressurized. One ink droplet is thus discharged from the nozzle 8. When one ink droplet adheres to the printing paper P, one dot is formed.

As described above, in order to discharge one ink droplet from the nozzle 8, a discharging pulse signal in which a high voltage is the base voltage is applied to the piezoelectric element 20. The technique of the present embodiment is termed 'fill before fire'. If a pulse width of the discharging pulse signal (i.e. the period of the region Y in FIG. 6 (B)) is set to a time AL taken for a pressure wave to proceed from an opening of the aperture 12 (the left side in FIG. 6 (A) etc.) to the nozzle 8, the discharge speed of the ink droplet will be at its maximum. A period X1, in which a pressure wave generated by the pressure decreasing of the pressure chamber 10 returns to this pressure chamber 10 after having proceeded from the pressure chamber 10 to the nozzle 8, is consequently the same as the time AL in which a pressure wave proceeds from the opening of the aperture 12 (from the ink chamber E1) to the nozzle 8. Further, a period X2, in which a pressure wave generated by the pressure decreasing of the pressure chamber 10 returns to this pressure chamber 10 after having proceeded from the pressure chamber 10 to the opening of the aperture 12, is the same as the time AL in which a pressure wave proceeds from the opening of the aperture 12 (from the ink chamber E1) to the nozzle 8.

When a negative pressure wave generated by the pressure decreasing of the pressure chamber 10 proceeds to the nozzle 8 or the aperture 12, the pressure wave is reversed to become a positive pressure wave, and is reflected toward the pressure chamber 10. If voltage is applied to the piezoelectric element 20 at the time at which the positive pressure wave arrives at the pressure chamber 10, there is an overlap of the pressure increase of the pressure chamber 10 and the arrival of the reversed positive pressure wave. A large positive pressure can thus be obtained, and the ink is effectively discharged from the pressure chamber 10. The time for the reversed positive pressure wave to return to the pressure chamber 10 after the pressure of the pressure chamber 10 was reduced is the same as AL.

Next, the configuration of the controller 100 for controlling the ink jet heads 2*a* to 2*d* will be described. The controller 100 prints on the printing paper P by causing ink to be discharged from the nozzles 8 while moving the printing paper P in the direction of the arrow P3.

Figure 7:
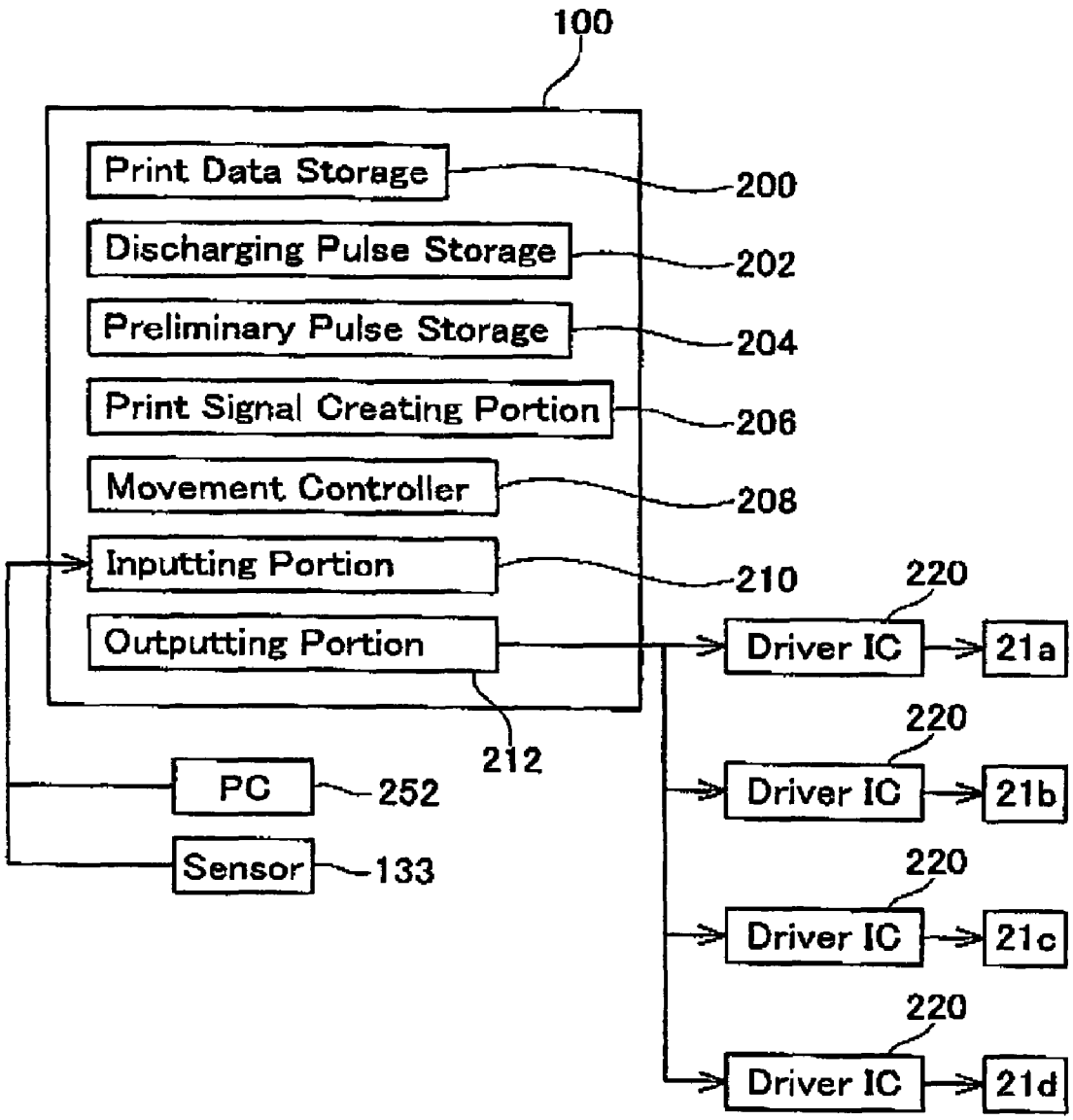
FIG. 7 shows the configuration of a controller and its surrounds.

FIG. 7 is a block view showing the functions of the controller 100. The controller 100 comprises a CPU (Central Processing Unit), a ROM (Read Only Memory), a RAM (Random Access Memory), etc. Each section in FIG. 7 is constructed by these members. The CPU is a processing unit. The CPU executes programs stored in the ROM. The ROM stores programs to be executed by the CPU, and stores data used in the execution of these programs. The RAM temporarily stores data.

The controller 100 comprises a print data storage 200, a discharging pulse storage 202, a preliminary pulse storage 204, a print signal creating portion 206, a movement controller 208, an inputting portion 210, and an outputting portion 212, etc.

The print data storage 200 stores print data output from a PC 252. The print data will be described later.

Figure 8:
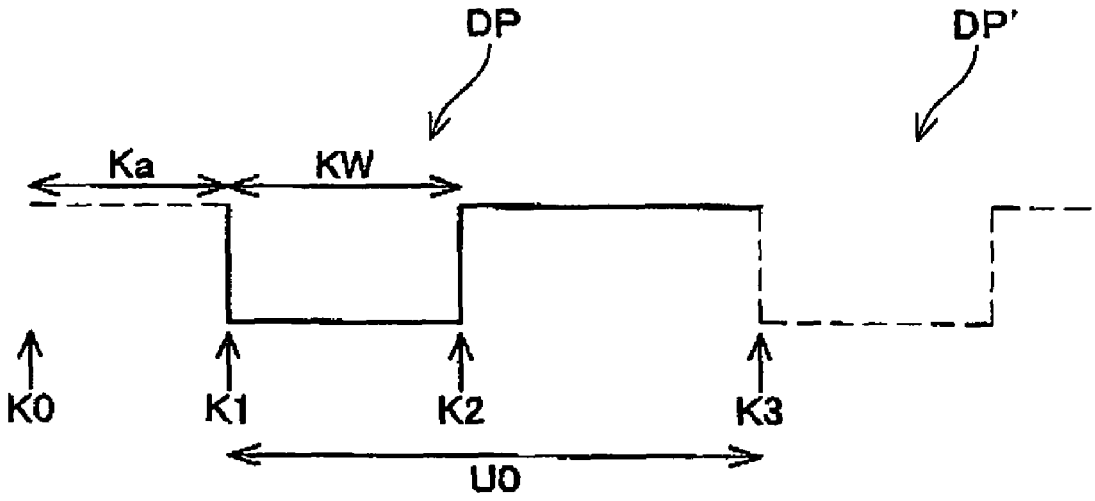
FIG. 8 shows an example of contents stored in a discharging pulse storage.

The discharging pulse storage 202 stores the timing of rises and falls of discharging pulse signals. FIG. 8 schematically shows contents stored in the discharging pulse storage 202. In FIG. 8, the reference number DP refers to the discharging pulse signal. The reference number DP' refers to a discharging pulse signal that follows the discharging pulse signal DP. In the case where a fall time K1 of the discharging pulse signal DP is zero, the discharging pulse storage 202 stores 'a rise time K2, and an ending time K3 of one unit period U0.' The difference between K1 and K2 is a pulse width KW of the discharging pulse signal DP. KW of the present embodiment is set to be the time AL (approximately 6 μs) taken for a pressure wave generated by the pressure decreasing of the pressure chamber 10 to proceed from the ink chamber to the nozzle 8. KW of the present embodiment is set to be the value AL (a specified value AL) calculated theoretically from the structure of the ink jet head 2.

The difference between K1 and K3 is the time of the unit period U0. In the present embodiment, the unit period is set as approximately 50 (μs). The unit period U0 is a base period for the printing operation. The unit period U0 is set in accordance with the printing resolution in the direction of the arrow P3 (see FIG. 1, etc.). In the present embodiment, the difference between K2 and 13 is approximately 44 (μs). This value is greater than half of one unit period U0.

Although this will be described in detail later, the controller 100 selects piezoelectric elements 20 to which the discharging pulse signal DP will be applied during one unit period. One discharging pulse signal DP is applied to each of the piezoelectric elements 20 that have been selected. Ink droplets are thus discharged from the nozzles 8 corresponding to the selected piezoelectric elements 20, and dots are formed.

Further, the discharging pulse storage 202 stores a period Ka from the time when the tip of the printing paper P was detected by the sensor 133 of FIG. 1 to the first unit period U0. That is, if the time at which the tip of the printing paper P is detected is K0 of FIG. 8, the time between K0 and K1 is stored.

Figure 9:
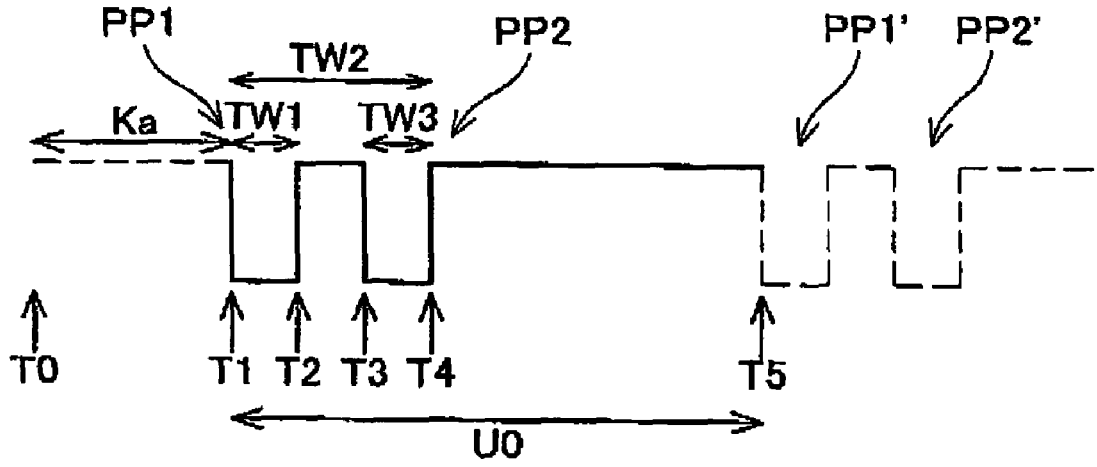
FIG. 9 shows an example of contents stored in a preliminary pulse storage.

In the present embodiment, a preliminary pulse signal is applied to the piezoelectric elements 20 to which the discharging pulse signal DP is not applied during one unit period. The preliminary pulse storage 204 stores the timing of rises and falls of the preliminary pulse signals. FIG. 9 schematically shows contents stored in the preliminary pulse storage 204. In the present embodiment, two preliminary pulse signals PP1 and PP2 are applied during one unit period U0. The reference numbers PP1' and PP2' refer to two preliminary pulse signals applied in the next unit period U0.

In the case where a fall time T1 of the preliminary pulse signal PP1 is zero, the preliminary pulse storage 204 stores 'a rise time T2 of the first preliminary pulse signal PP1, a fall time T3 of a second preliminary pulse signal PP2, a rise time T4 of the second preliminary pulse signal PP2, and an ending time T5 of the unit period U0.' The difference between T1 and T2 is a pulse width TW1 of the first preliminary pulse signal PP1. In the present embodiment, TW1 is set to be approximately 1.25 (μs). This value is included within the range AL (6 (μs))×1/6 and AL×1/4. Further, in the present embodiment, the difference between T2 and T3 is set to be approximately 1.25 (μs). The difference between T3 and T4 is a pulse width TW3 of the second preliminary pulse signal PP2. In the present embodiment, TW3 is set to be approximately 1.25 (μs). That is, TW1 and TW3 are identical. The difference TW2 between T1 and T4 is set to be approximately 3.75 (μs). TW2 is a value less than 2/3 of AL (6 (μs)). The difference between T1 and T5 is the time of one unit period U0. This unit period U0 is identical with the unit period U0 stored in the discharging pulse signal storage 202. Furthermore, in the present embodiment, the difference between T4 and T5 is approximately 46.25 (μs). This value is greater than half of one unit period U0.

The preliminary pulse storage 204 stores the period Ka from the time when the tip of the printing paper P was detected by the sensor 133 of FIG. 1 to the first unit period. That is, if the time at which the tip of the printing paper P is detected is T0 of FIG. 9, the time between T0 and T1 is stored. The time between T0 and T1 is the same as the time between K0 and K1 (see FIG. 8).

If TW1, TW2, and TW3 are set at the aforementioned values, the ink is not discharged even if the preliminary pulse signals PP1 and PP2 are applied to the piezoelectric elements 20. In this case, the piezoelectric elements 20 to which the preliminary pulse signals PP1 and PP2 have been applied deform twice as shown in FIG. 6 (A) to (C). A pressure wave is generated within the pressure chamber 10 when the piezoelectric element 20 deforms. The ink oscillates within the ink passage (the passage from the ink chamber to the nozzle 8) due to the pressure wave. This oscillation is termed a preliminary oscillation.

The print signal creating portion 206 creates print signals based on the print data stored in the print data storage 200. The print data has been output from the PC 252. The print data includes information showing the coordinate and color of a dot to be formed on the printing paper P. The print signal is data showing the timing with which the discharging pulse signal should be applied and the piezoelectric element 20 to which it should be applied.

For example, the print data include information showing that a black dot should be formed at a coordinate (xA, yB). The print signal creating portion 206 can specify the piezoelectric element 20 (in this case 20A) for forming the black dot at the coordinate (xA, yB).

As described above, the printer 1 repeats the unit periods while the printing paper P is being moved in the direction P3 (see FIG. 1, etc.). The dots may be thus formed at all coordinates on the printing paper P. In order to form the black dot at the coordinate (xA, yB), the print signal creating portion 206 specifies the unit period in which the discharging pulse signal should be applied to the piezoelectric element 20A. In this example, this is a unit period B.

The print signal creating portion 206 determines the timing with which the discharging pulse signal falls and rises based on the contents stored in the discharging pulse storage 202. For example, if the discharging pulse signal is applied at the unit period B, the timing at which the discharging pulse signal falls is Ka+(B−1)×U0. Further, the timing at which the discharging pulse signal rises is Ka+(B−1)×U0+K2.

The print signal creating portion 206 can create the information for forming one dot by going through the above processes. That is, the print signal creating portion 206 can create the information (the print signal) having the combination of the piezoelectric element to which the discharging pulse signal should be applied (for example, 20A), the timing at which the discharging pulse signal falls (for example, Ka+(B−1)×U0), and the timing at which the discharging pulse signal rises (for example, Ka+(B−1)×U0+K2). The print signal creating portion 206 creates the aforementioned information for all the dots formed on the printing paper P. The print signal created by the print signal creating portion 206 is output as a serial signal to the driver IC 220 via the outputting portion 212.

As described above, the print signal creating portion 206 can specify the piezoelectric elements 20 to which the discharging pulse signal should be applied during each unit period based on the print data stored in the print data storage 200. In other words, the print signal creating portion 206 can specify the piezoelectric elements 20 to which the discharging pulse signal should not be applied during each unit period. The print signal creating portion 206 creates a print signal for applying the preliminary pulse signal to the piezoelectric elements 20 to which the discharging pulse signal is not applied. Here, a case in which the preliminary pulse signal is applied to the piezoelectric element 20A during a unit period C is used as an example, and the process of creating the print signal for this purpose will be described. The print signal creating portion 206 determines the timing with which the preliminary pulse signal falls and rises. If the preliminary pulse signal is applied at the unit period C, the timing at which the first preliminary pulse signal falls is Ka+(C−1)×U0. Further, the timing at which the first preliminary pulse signal rises is Ka+(C−1)×U0+T2. The timing at which the second preliminary pulse signal falls is Ka+(C−1)×U0+T3, and the timing at which the second preliminary pulse signal rises is Ka+(C−1)×U0+T4.

The print signal creating portion 206 can create the information for applying the preliminary pulse signals. That is, the print signal creating portion 206 can create the information (the print signal) having the combination of the piezoelectric element (20A) to which the preliminary pulse signal is applied, the timing at which the first preliminary pulse signal falls the timing at which the first preliminary pulse signal rises, the timing at which the second preliminary pulse signal falls, and the timing at which the second preliminary pulse signal rises. The print signal that has been created is output to the driver IC 220 via the outputting portion 212.

The movement controller 208 controls the conveying motor 147 (see FIG. 1). The printing paper P is thus conveyed on the belt 111. In the present embodiment, the speed with which the printing paper P on the belt 111 is conveyed is constant. Further, the movement controller 208 controls a motor for driving the paper supply roller 145 (see FIG. 1), and controls a motor for driving the rollers 118*a*, 118*b*, 119*a*, 119*b*, 121*a*, 121*b*, 122*a*, and 122*b*.

The PC 252 and the sensor 133 (see FIG. 1) are connected with the inputting portion 210. The PC 252 converts an image that has been instructed by the user into print data. The print data is data showing the coordinate at which the dot should be formed and the color of that dot. The PC 252 outputs the print data to the printer 1. The print data output from the PC 252 is input to the inputting portion 210. The print data that has been input to the inputting portion 210 is stored in the print data storage 200.

The sensor 133 outputs detection signals when the sensor 133 detects a tip of the printing paper P. The detection signals are input to the inputting portion 210. The controller 100 can determine the timing with which the pulse signals (the discharging pulse signals or the preliminary pulse signals) are applied to the piezoelectric elements 20 by using the detection signals input to the inputting portion 210. That is, the timing at which the first unit period should be started can be determined.

The outputting portion 212 is connected with the driver IC 220. In this embodiment, one driver IC 220 is formed to one actuator unit 21. Consequently, there are sixteen driver ICs 220. In FIG. 7, four actuator units 21*a*~21*d* of only one ink jet head 2 and the four driver ICs 220 are shown. The driver IC 220 inputs the print signals output from the controller 100. The driver IC 220 converts the print signal of the serial signal into a parallel signal and amplifies it. The print signal converted into the serial signal is provided to the actuator unit 21 through the FPC (not shown).

The driver IC 220 creates pulse signals based on the information included in the print signals. For example, in the case where the print signal includes the information having the combination of the piezoelectric element 20A, a timing tA at which the discharging pulse signal falls and a timing tB at which the discharging pulse signal rises, a discharging pulse signal in which the pulse signal falls at the timing tA and rises at the timing tB is created. The driver IC 220 applies the discharging pulse signal that has been created to the piezoelectric element 20A. In this case, the piezoelectric element 20A deforms, and an ink droplet is discharged from the nozzle 8.

As another example, in the case where the print data includes the information having the combination of the piezoelectric element 20A, a timing tC at which the first preliminary pulse signal falls and a timing tD at which the first preliminary pulse signal rises, a timing tE at which the second preliminary pulse signal falls and a timing tF at which the second preliminary pulse signal rises, a preliminary pulse signal in which the pulse signal falls at the timing tC and rises at the timing tD is created, and a preliminary pulse signal in which the pulse signal falls at the timing tE and rises at the timing tF is created. The driver IC 220 applies the preliminary pulse signals that have been created to the piezoelectric element 20A. In this case, the piezoelectric element 20A deforms, but an ink droplet is not discharged from the nozzle 8. The ink within the ink passage does the preliminary oscillation.

Figure 10:
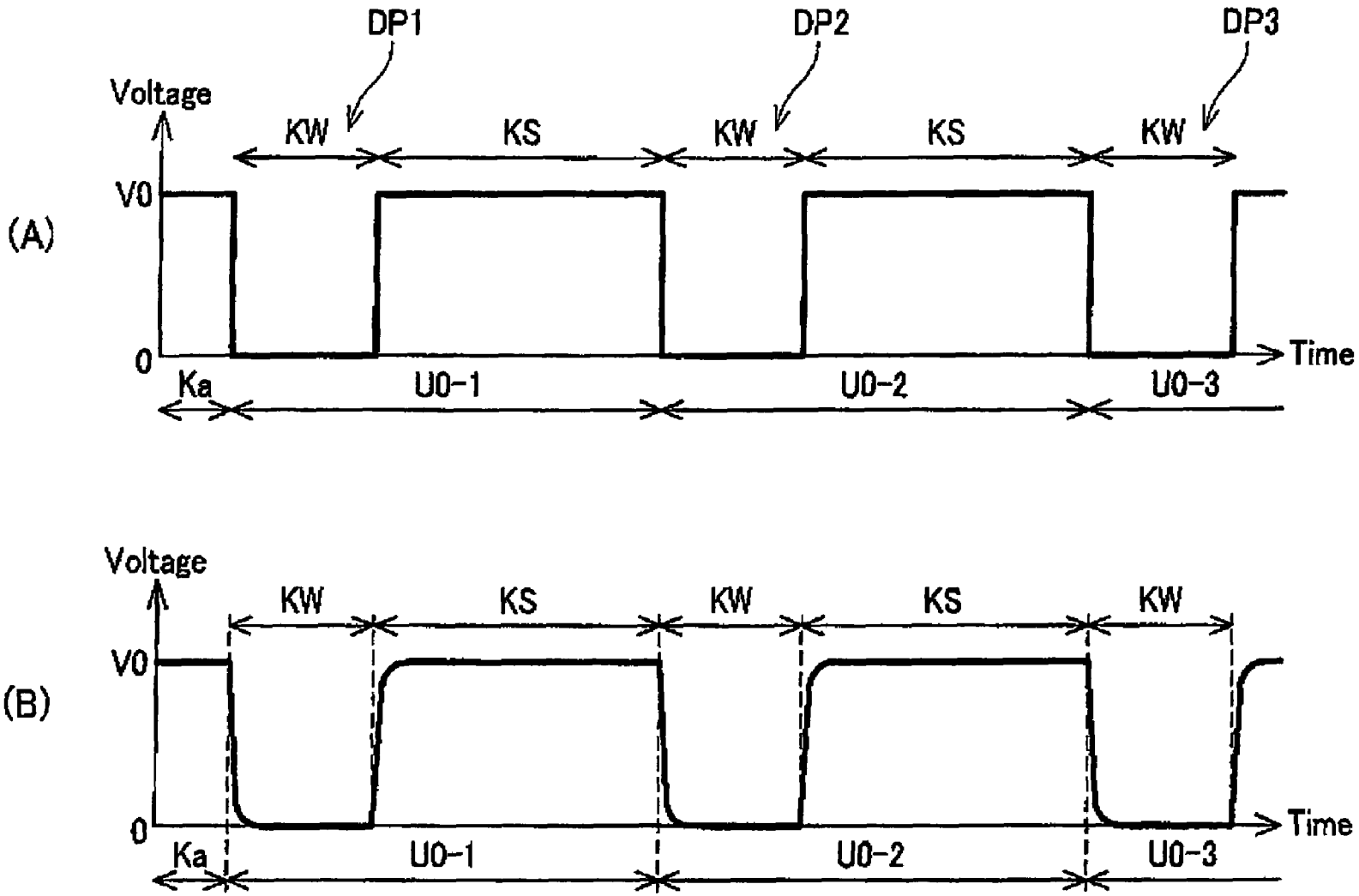
FIG. 10 (A) shows three discharging pulse signals.

FIG. 10 (A) shows waveforms of three discharging pulse signals DP1, DP2 and DP3. In this example, the discharging pulse signal DP1 is applied in a unit period U0-1. The discharging pulse signal DP2 is applied in a unit period U0-2, and the discharging pulse signal DP3 is applied in a unit period U0-3.

FIG. 10 (B) shows how voltage of the piezoelectric element 20 changes when the discharging pulse signals of FIG. 10 (A) have been applied. The piezoelectric element 20 forms a condenser due to the individual electrodes 35, the common electrode 34, and the piezoelectric sheet 41 (see FIG. 4). As a result, the voltage of the piezoelectric element 20 changes somewhat more slowly than the discharging pulse signal.

In the case of the example of FIG. 10, three ink droplets are discharged from the nozzle 8. In this case, three ink dots are aligned in the direction P3 (see FIG. 1, etc.).

In the present embodiment, a period KS from the timing of a rise of a discharging pulse signal (for example, DP1) to the timing of a fall of a next discharging pulse signal (for example, DP2) is set to be greater than half of one unit period U0.

Figure 11:
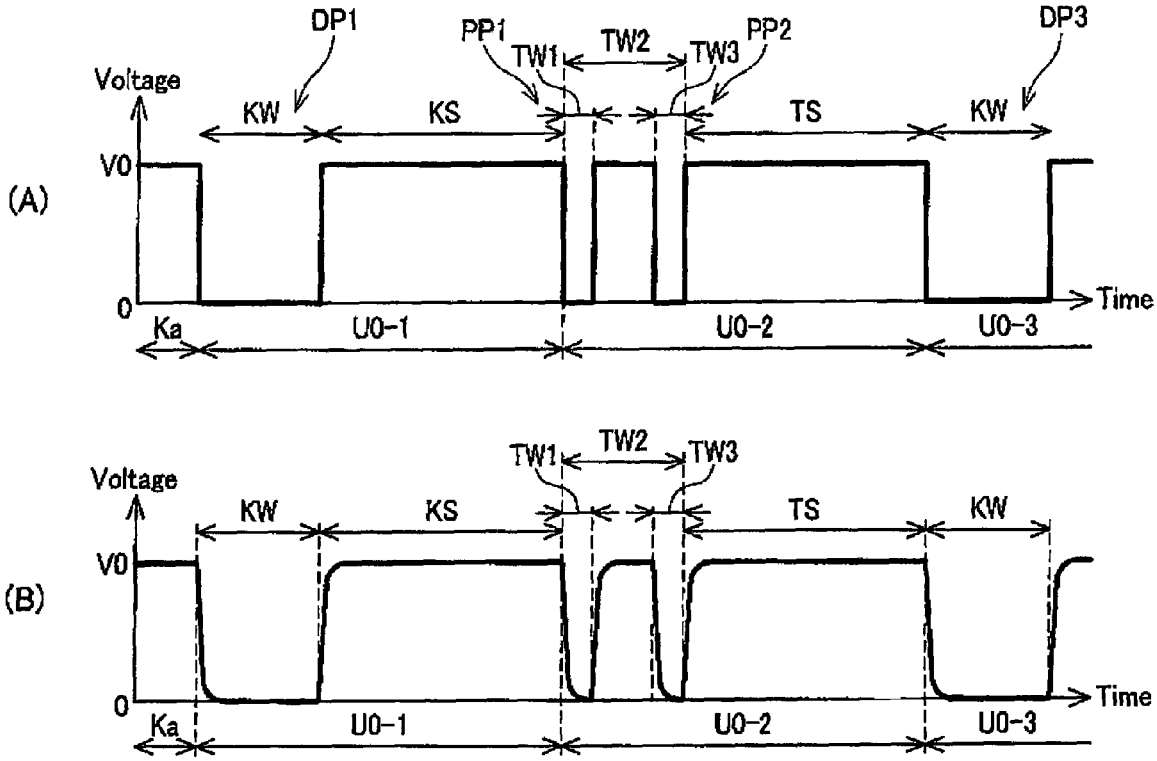
FIG. 11 (A) shows two discharging pulse signals and two preliminary pulse signals.

FIG. 11 (A) shows waveforms of the two discharging pulse signals DP1 and DP3, and two preliminary pulse signals PP1 and PP2. In this example, the discharging pulse signal DP1 is applied in the unit period U0-1. The preliminary pulse signals PP1 and PP2 are applied in the unit period U0-2, and the discharging pulse signal DP3 is applied in the unit period U0-3.

FIG. 11 (B) shows how the voltage of the piezoelectric element 20 changes when the pulse signals of FIG. 11 (A) have been applied. The voltage of the piezoelectric element 20 changes somewhat more slowly than the pulse signals.

In the case of the example of FIG. 11, an ink droplet is discharged from the nozzle 8 in the first unit period U0-1, thus forming one dot. The piezoelectric element 20 deforms in the next unit period U0-2 but an ink droplet is not discharged from the nozzle 8. An ink droplet is discharged from the nozzle 8 in the next unit period U0-3, thus forming one dot. In this case, one dot, a blank having the size of one dot, and then one dot are aligned in the direction P3 (see FIG. 1, etc.).

In the present embodiment, a period TS from the timing of a rise of a second preliminary pulse signal (for example, PP2) of one unit period to the timing of a fall of a discharging pulse signal (for example, DP3) of a next unit period, is set to be greater than half of one unit period U0.

Next, the results of tests executed by the present inventors will be described.

Figure 12:
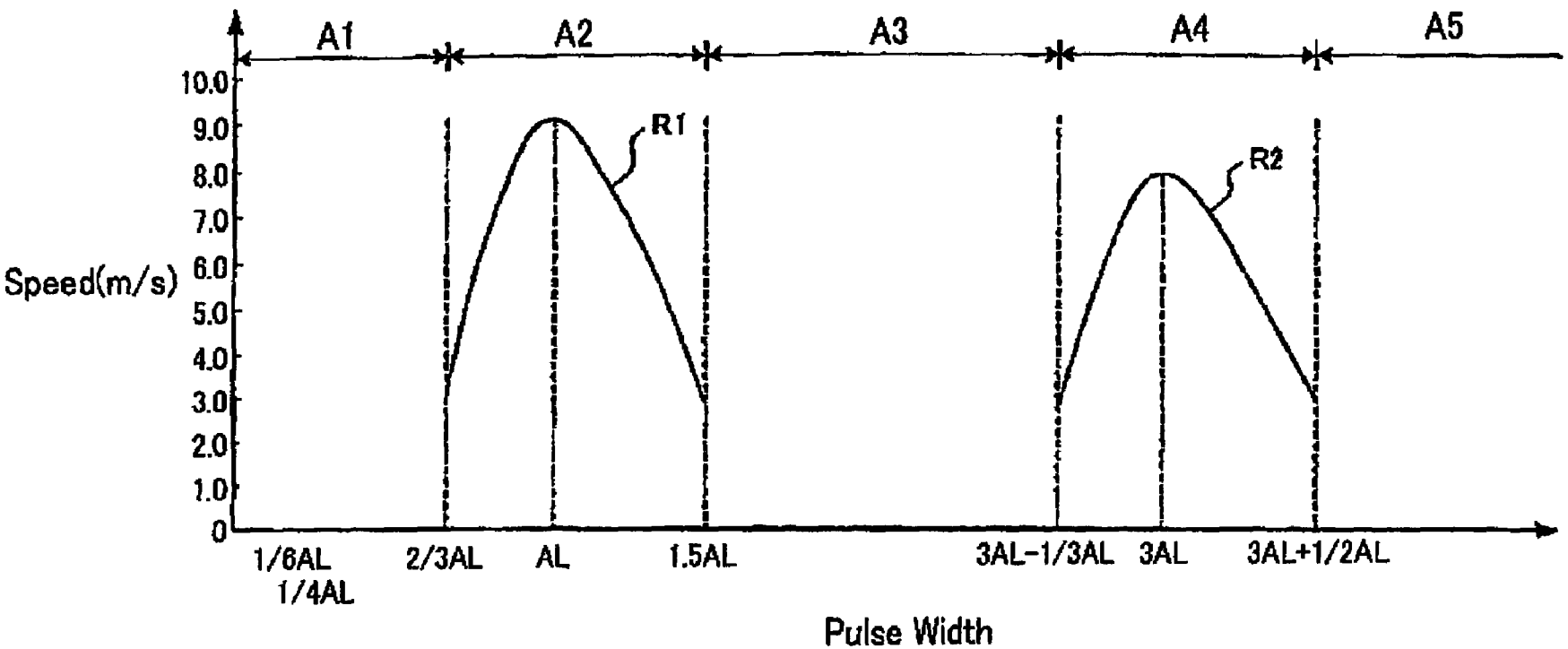
FIG. 12 shows a graph showing the relationship between pulse width and discharge speed of ink.

FIG. 12 shows a graph showing pulse width of a pulse signal on a horizontal axis and ink droplet discharge speed on a vertical axis. Curved lines R1 and R2 of FIG. 12 have been obtained by plotting the ink droplet discharge speed when the pulse width of the pulse signal has been varied. The curved line R1 is a curved line that protrudes upwards, and is the maximum ink discharge speed when the pulse width is the time AL. The curved line R2 is a curved line that protrudes upwards, and is the maximum ink discharge speed when the pulse width is the time 3AL. Although this is not drawn in FIG. 12, there are also curved lines R3, R4, etc. which, like the curved lines R1 and R2, are the maximum ink discharge speeds when the pulse widths are 5AL, 7AL, etc.

As shown in FIG. 12, the relationship between the pulse width and the ink discharge speed can be represented as a plurality of curved lines whose peak occurs at AL multiplied by the odd number (2n−1), where n is a positive integer. For example, a pulse signal with a pulse width AL is applied to the piezoelectric element 20. In this case, a negative pressure wave is generated in the pressure chamber 10 at the timing at which the pulse signal falls. This negative pressure wave is reflected from the nozzle 8, becomes a positive pressure wave, and returns to the pressure chamber 10. Further, the negative pressure wave is reflected from the aperture 12, becomes a positive pressure wave, and returns to the pressure chamber 10. The timing at which the former positive pressure wave returns to the pressure chamber 10 is approximately the same as the timing at which the latter positive pressure wave returns to the pressure chamber 10. The time from the generation of the negative pressure wave until the positive pressure wave returns to the pressure chamber 10 is AL. If the timing at which the positive pressure wave returns to the pressure chamber 10 and the timing at which the pulse signal rises (the timing at which the pressure in the pressure chamber 10 is increased) are the same, it is possible to obtain a large positive pressure wave. The ink can thus be discharged at high speed. However, if there is a discrepancy between the timing at which the positive pressure wave returns to the pressure chamber 10 and the timing at which the pulse signal rises, the discharge speed of the ink will become slower, and the ink may not be discharged. The pressure wave moves back and forth within the ink passage. As a result, as shown in FIG. 12, the pulse width for discharging the ink and the pulse width for not discharging the ink are repeated at predetermined periods. The present inventors learnt from tests that this period is 2×AL.

In FIG. 12, ink is discharged from the nozzle 8 within the ranges A2 and A4 plotted by the curved lines R1 and R2. That is, the ink is discharged within the range (2n−4/3)×AL and (2n−1/2)×AL. The peak of the curved line R1 is greater than the peak of the curved line R2. That is, the ink droplet discharge speed is maximum when the pulse width is AL. As described above, AL has been adopted as the pulse width of the discharging pulse signal in the printer 1 of the present embodiment. As a result, the ink droplets are discharged at the maximum discharge speed.

By contrast, the ranges A1, A3 and A5 not plotted by the curved lines R1 aid R2 represent ranges in which the ink is not discharged from the nozzle 8. That is, the ink is not discharged within the range 2/3×AL or below, or within the range between (2n−1/2)×AL and (2n+2/3)×AL. In the printer 1 of the present embodiment, the pulse width of the preliminary pulse signal is set to be within the range between 1/6×AL and 1/4×AL. The pulse width of the preliminary pulse signal is 2/3×AL or below. As a result, the ink is not discharged even when the preliminary pulse signal is applied.

Next, the effects will be described that a pressure wave generated in the unit period U0 exerts when ink is to be discharged in the next unit period.

The present inventors performed the following tests.

(1) Two preliminary pulse signals were applied within one unit period, and then a discharging pulse signal was applied within the next unit period.

(2) The test (1) was executed while varying the time from the rise of the second preliminary pulse signal to the fall of the discharging pulse signal.

FIG. 13 shows the results of the tests. TW2 (see FIG. 11 (A)) is the time from the fall of the first preliminary pulse signal to the rise of the second preliminary pulse signal. U0 is one unit period. If the ratio of TW2 to U0 is small, the period TS (see FIG. 11 (A)) from the rise of the second preliminary pulse signal to the fall of the discharging pulse signal is greater. If the ratio of TW2 to U0 is large, TS (see FIG. 11 (A)) is smaller. In FIG. 13, 'O' indicates satisfactory results, and 'X' indicates unsatisfactory results. Unsatisfactory results may refer to there being a discrepancy in the position of impact of the ink droplets on the print medium. Otherwise, unsatisfactory results may refer that the amount of ink discharged is smaller, etc.

As shown in FIG. 13, the results are satisfactory when the ratio of TW2 to U0 is 4/8 or below. The fact that satisfactory results are obtained when the ratio is 4/8 or below is thought to be due to the period of TS (see FIG. 11 (A)) being longer. When TS is longer, the pressure wave generated in the first unit period is weaker by the time of the next unit period. As a result, the pressure wave generated in the first unit period does not adversely affect the next unit period.

By contrast, the results are unsatisfactory when the ratio of TW2 to U0 is 5/8 or above. The fact that satisfactory results cannot be obtained when the ratio exceeds 1/2 is thought to be due to the period of TS being shorter. When TS is shorter, the pressure wave generated in the first unit period adversely affects the next unit period.

In the printer 1 of the present embodiment, TS is set to be a value at least half of the unit period. Consequently, satisfactory printing results can be obtained.

The results of FIG. 13 could be applied to a case in which a discharging pulse signal is applied within one unit period, and a discharging pulse signal is applied within the next unit period. That is, if the period KS (see FIG. 10 (A)) from the rise of the discharging pulse signal to the fall of the discharging pulse signal in the next unit period is at least 1/2 the unit period U0, printing results should be satisfactory.

In the printer 1 of the present embodiment, KS is set to be a value at least half of the unit period. Consequently, satisfactory printing results can be obtained.

In the present embodiment, two preliminary pulse signals are applied within one unit period. In this case, a pressure wave generated by applying the first preliminary pulse signal may have adverse effects when the second preliminary pulse signal is applied. For example, the ink may be discharged from the nozzle 8 when the second preliminary pulse signal is applied. The present inventors performed the following tests to ascertain the conditions under which the ink is discharged from the nozzle 8 when the second preliminary pulse signal is applied.

(1) Two preliminary pulse signals having the same pulse width were applied to the piezoelectric element 20, and it was observed whether ink was discharged.

(2) The test (1) was executed while varying the pulse widths of the two preliminary pulse signals, and while varying the period between the two preliminary pulse signals. Both preliminary pulse signals had identical pulse widths.

FIG. 14 shows the results of the tests. X (μs) in FIG. 14 represents the pulse width (TW1 and TW3 of FIG. 11 (A)) of the first pulse signal. Y (μs) in FIG. 14 represents the period (TW2 in FIG. 11 (A)) from the fall of the first preliminary pulse signal to the rise of the second preliminary pulse signal. In the figure, 'O' and 'triangle' represent ink not having been discharged. 'triangle' represents the amount of oscillation of the ink being greater than for 'O'. 'X' represents ink having been discharged. '-' represents being outside the target of the test. This is because Y must be greater than 2×X. Further, the printer utilized in these tests had AL of approximately 6 (μs).

For example, when X was 1 (μs) and Y was 4 (μs), the result was 'O'. That is, when the pulse width of each preliminary pulse signal was 1 (μs) and the period between the preliminary pulse signals was 2 (μs), ink was not discharged.

As another example, when X was 1 (μs) and Y was 5 (μs), the result was W. That is, when the pulse width of each preliminary pulse signal was 1 (μs) and the period between the preliminary pulse signals was 3 (μs), ink was discharged.

As another example, when X was 1 (μs) and Y was 9 (μs), the result was 'O'. That is, when the pulse width of each preliminary pulse signal was 1 (μs) and the period between the preliminary pulse signals was 7 (μs), ink was not discharged.

As described above, the effects of the pressure wave were repeated within the same period (AL×2; see FIG. 12). In light of this, it was understood from the test results of FIG. 14 that ink is discharged when X (TW1=TW3) is within a range between (2n−4/3)×AL and (2n−1/2)×AL. Further, ink is not discharged when Y (TW2) is 2/3×AL or below. Ink is not discharged when Y (TW2) is within a range between (2n−1/2)×AL and (2n+2/3)×AL. By contrast, ink is discharged when Y (TW2) is within a range between (2n−4/3)×AL and (2n−1/2)×AL.

In the printer 1 of the present embodiment, X is 1.25 (μs) and Y is 3.75 (μs). As a result, ink is not discharged even if two preliminary puke signals are applied within one unit period.

As described above, in the present embodiment, the ink is made to oscillate within the ink passage by applying the preliminary pulse signal to the piezoelectric element 20. The ink can thus be prevented from drying out. The printer 1 of the present embodiment can prevent the ink from drying out using this new technique.

Devices for a purge process or a flushing process may probably be omitted when the present embodiment is utilized. That is, ink discharging problems way probably be eliminated without executing a process of discharging ink from the ink passage. In this case, less ink may be wasted.

In the present embodiment, two preliminary pulse signals are applied within one unit period. Since the preliminary oscillations are performed a plurality of times within one unit period, the ink may efficiently be prevented from drying out.

Further, in the present embodiment, the period TS (see FIG. 11 (A)) between the second preliminary pulse signal and the next discharging pulse signal is set to be long. Further, the period KS (see FIG. 10 (A)) between the discharging pulse signal and the next discharging pulse signal is also set to be long. As a result, the ink can prevented from being discharged in an unsatisfactory manner.

The discharging pulse signals have two voltage levels: VO and zero (see FIG. 10 (A)). Further, the preliminary pulse signals also have two voltage levels: VO and zero (see FIG. 11 (A)). The voltage levels for creating the two types of pulse signals are identical. Consequently, the configuration of a device for applying voltage may be simplified.

Some representative modifications to the aforementioned embodiment are listed here.

(1) The aforementioned embodiment may be applied to a serial type printer in which the ink jet heads move.

(2) Any value may be used for the pulse width of the discharging pulse signal as long as this pulse width is within the range between (2n−4/3)×AL and (2n−1/2)×AL.

3) Any value may be used for the pulse width of one preliminary pulse signal as long as this pulse width is 2/3×AL or below, or within the range between (2n−1/2)×AL and (2n+2/3)×AL.

(4) Any value may be used for the period from the fall of the first preliminary pulse signal to the rise of the second preliminary pulse signal as long as this period is 2/3×AL or below, or within the range between (2n−1/2)×AL and (2n+2/3)×AL.

(5) Only one preliminary pulse signal may be applied within one unit period.

(6) Three and above preliminary pulse signals may be applied within one unit period.

(7) The preliminary pulse signals may not be applied during the printing operation (within the unit period). For example, the preliminary pulse signals may be applied to the piezoelectric elements 20 immediately prior to the printing operation. In this case, the preliminary pulse signals may be applied simultaneously to all the piezoelectric elements 20. Otherwise, preliminary pulse signals with a time difference may be applied to the piezoelectric elements 20.

(8) In the aforementioned embodiment, the period AL, that is the time for the pressure wave to proceed from the nozzle to the ink chamber, was obtained by calculations based on the structure of the ink jet head. The discharge speed of the ink droplet was maximum when the specified value AL was utilized as the pulse width.

However, since errors may occur, the discharge speed of the ink droplet might not be maximum even when the specified value AL is being utilized as the pulse width. Further, if the configuration of the ink jet head differs from that of the aforementioned embodiment, the ink droplet discharge speed might not be maximum even when the time for the pressure wave to proceed from the nozzle to the ink chamber is being utilized as the pulse width.

A pulse width AL' in which a maximum ink droplet discharge speed is obtained may be found as follows.

(8-1) A pulse signal having a predetermined pulse width (for example, W1) is applied to a plurality of piezoelectric elements of an ink jet printer that has been manufactured. The discharge seed of ink droplets discharged from the nozzles is measured. An average value is calculated from the measured discharge speed.

(8-2) The process of (8-1) is executed with varying pulse widths. The average value of the discharge speed of the ink droplets for each of the pulse widths is calculated.

(8-3) The results obtained in (8-1) and (8-2) are plotted in a graph in which pulse width is on the horizontal axis and discharge speed is on the vertical axis. Then a curved line is drawn passing through the points that have been plotted. When the curved line is drawn, a pulse width AL' in which the maximum discharge speed can be obtained may be specified.

What is claimed is:

1. An ink jet printer, comprising:

an ink jet head including a nozzle, an ink chamber communicating with the nozzle, a pressure chamber located between the nozzle and the ink chamber, and an actuator that changes volume of the pressure chamber;

a controller that controls the actuator to perform a first performance, the first performance including a first change in which the volume of the pressure chamber increases, and a second change in which the volume of the pressure chamber decreases; and a transferring device that transfers at least one of the ink jet head and a print medium along a predetermined direction in a state in which the nozzle faces the print medium, wherein a period from the first change to the second change is 2/3×AL or below, or within a range between (2s−1/2)×AL and (2s+2/3)×AL, s is a positive integer, discharging speed of ink discharged from the nozzle is substantially maximum if the period from the first change to the second change is set to AL, the controller is capable of controlling the actuator to perform a second performance, the second performance includes a third change in which the volume of the pressure chamber increases, and a fourth change in which the volume of the pressure chamber decreases, a period from the third change to the fourth change is within a range between (2t−4/3)×AL and (2t−1/2)×AL, and t is a positive integer, the ink jet printer prints on the print medium by repeating a unit period while the transferring device transfers the ink jet head or the print medium along the predetermined direction, the controller controls the actuator to perform either the first performance or the second performance in each unit period, the nozzle discharges ink to form one dot when the actuator performs the second performance in one unit period, and the nozzle does not discharge ink when the actuator performs the first performance in one unit period.

2. The ink jet printer as in claim 1, wherein a period from the second change of the first performance performed in the unit period to the third change of the second performance performed in the next unit period is longer than half of one unit period.

3. The ink jet printer as in claim 1, wherein a period from the fourth change of the second performance performed in the unit period to the third change of the second performance performed in the next unit period is longer than half of one unit period.

4. The ink jet printer as in claim 1, wherein the controller controls the actuator to perform the first performance at least twice in one unit period.

5. The ink jet printer as in claim 4, wherein a period from the second change of the first performance last performed in one unit period to the third change of the second performance performed in the next unit period is longer than half of one unit period.

6. The ink jet printer as in claim 1, wherein the controller controls the actuator to perform the first performance twice in one unit print period, a period from the first change of a former first performance to the second change of a latter first performance is 2/3×AL or below, or within a range between (2u−1/2)×AL and (2u+2/3)×AL, and u is a positive integer.

7. The ink jet printer as in claim 1, wherein the period from the first change to the second change is 2/3×AL or below.

8. The ink jet printer as in claim 7, wherein the period from the first change to the second change is within a range between 1/6×AL and 1/4×AL.

9. The ink jet printer as in claim 1, wherein the actuator is a piezoelectric element, the controller changes voltage applied to the piezoelectric element from a first level to a second level in order to perform the first change and the third change, and the controller changes voltage applied to the piezoelectric element from the second level to the first level in order to perform the second change and the fourth change.

10. The ink jet printer as in claim 1, wherein

AL is the time for a pressure wave generated by the first change to proceed from the ink chamber to the nozzle.

11. A method of controlling an ink jet printer, the ink jet printer including an ink jet head having a nozzle, an ink chamber communicating with the nozzle, a pressure chamber located between the nozzle and the ink chamber, and an actuator that changes voltage of the pressure chamber, the method comprising:

a step of controlling the actuator to perform a first performance, the first performance including a first change in which the volume of the pressure chamber increases, and a second change in which the volume of the pressure chamber decreases;

a step of controlling the actuator to perform a second performance, the second performance includes a third change in which the volume of the pressure chamber increases, and a fourth change in which the volume of the pressure chamber decreases, and a step of transferring at least one of the ink jet head and a print medium along a predetermined direction in a state in which the nozzle faces the print medium, wherein a period from the first change to the second change is $2/3\times AL$ or below, or within a range between $(2s-1/2)\times AL$ and $(2s+2/3)\times AL$, s is a positive integer, discharging speed of ink discharged from the nozzle is substantially maximum if the period from the first change to the second change is set to AL, a period from the third change to the fourth change is within a range between $(2t-4/3)\times AL$ and $(2t-1/2)\times AL$, t is a positive integer, the ink jet printer prints on the medium by repeating a unit period while at least one of the ink jet head or the print medium is transferred along the predetermined direction in the transferring step, either the first performance or the second performance is performed in each unit period, the nozzle discharges ink to form one dot when the second performance is performed in one unit period, and the nozzle does not discharge ink when the first performance is performed in one unit period.

12. A computer-readable medium having a computer program stored thereon, the computer program executed by a computer device mounted on the ink jet printer, the computer program including instructions for ordering the computer device to perform the method of claim 11.

* * * * *